US009179511B2

(12) United States Patent
Sugiura et al.

(10) Patent No.: US 9,179,511 B2
(45) Date of Patent: Nov. 3, 2015

(54) LIGHT-EMITTING DEVICE, AND LIGHT SOURCE FOR LIGHTING AND LIGHTING APPARATUS USING THE SAME

(71) Applicant: Panasonic Corporation, Osaka (JP)

(72) Inventors: Kenji Sugiura, Osaka (JP); Ryouji Yokotani, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/322,001

(22) Filed: Jul. 2, 2014

(65) Prior Publication Data

US 2015/0008835 A1 Jan. 8, 2015

(30) Foreign Application Priority Data

Jul. 8, 2013 (JP) ..... 2013-143111

(51) Int. Cl.
*H05B 33/08* (2006.01)
*F21S 4/00* (2006.01)

(52) U.S. Cl.
CPC ..... *H05B 33/0824* (2013.01); *F21S 4/001* (2013.01); *H05B 33/0815* (2013.01)

(58) Field of Classification Search
CPC .. F21S 4/001; H05B 33/0815; H05B 33/0821
USPC ..... 315/192, 185 R
See application file for complete search history.

(56) References Cited

U.S. PATENT DOCUMENTS

| | | | | |
|---|---|---|---|---|
| 8,710,754 | B2 * | 4/2014 | Baddela et al. | 315/192 |
| 2010/0264832 | A1 * | 10/2010 | Archenhold et al. | 315/152 |
| 2012/0038280 | A1 * | 2/2012 | Zoorob et al. | 315/151 |
| 2012/0213504 | A1 * | 8/2012 | Ollila et al. | 396/205 |
| 2014/0008632 | A1 | 1/2014 | Kuzuoka et al. | |
| 2014/0361697 | A1 * | 12/2014 | Miskin | H05B 33/0821 315/192 |

FOREIGN PATENT DOCUMENTS

JP 2011-176017 9/2011

* cited by examiner

*Primary Examiner* — Dylan White
(74) *Attorney, Agent, or Firm* — Greenblum & Bernstein, P.L.C.

(57) ABSTRACT

A light-emitting device includes a first light-emitting element and a second light-emitting element. The first light-emitting element has a first LED, and emits a first spectrum. The second light-emitting element has a second LED and a constant voltage element connected in series, and emits a second spectrum different from the first spectrum. The second light-emitting element is connected in parallel to the first light-emitting element. First light-emitting element and the second light-emitting element are configured such that their lines indicating the forward current-forward voltage characteristics cross each other. This enables to change spectral distribution emitted from the light-emitting device just by changing power supplied from a single power circuit.

16 Claims, 25 Drawing Sheets

LIGHT-EMITTING DEVICE, AND LIGHT SOURCE FOR LIGHTING AND LIGHTING APPARATUS USING THE SAME

BACKGROUND OF THE INVENTION

1. Field of the Invention

The field relates to light-emitting devices, and light sources for lighting and lighting apparatuses in which light-emitting devices are used.

2. Background Art

Semiconductor light-emitting elements, such as light-emitting diode (LED), are broadly used in a range of apparatuses as highly-efficient and space-saving light sources. For example, LEDs are used as light sources for lighting, such as an LED bulb lamp and straight-tube LED lamp, and backlight light sources for liquid crystal display devices. In this case, LEDs are unitized and built in a range of apparatuses in the form of LED modules (light-emitting devices).

These LED modules include a COB (Chip On Board) light-emitting device in which multiple LED chips are directly mounted on a board, and an SMD (Surface Mount Device) light-emitting device in which multiple packaged LED elements are mounted on a board.

For example, a COB light-emitting device includes multiple LEDs (LED element array) linearly aligned on a long board and linear sealing member (resin containing phosphor) for sealing multiple LEDs.

SUMMARY OF THE INVENTION

Light-emitting devices in exemplary embodiments include a first light-emitting element and a second light-emitting element. The first light-emitting element includes a first light-emitting diode, and emits a first spectrum. The second light-emitting element includes a second light-emitting diode and a constant voltage element connected in series to the second light-emitting diode, and emits a second spectrum different from the first spectrum. The second light-emitting element is connected in parallel to the first light-emitting element. A line indicating the relation between the forward current-forward voltage (IF-VF) of the first light-emitting element crosses with a line indicate the relation between the IF-VF of the second light-emitting element.

The above structure enables to change spectral distribution that the light-emitting device emits just by changing power supplied from a single power circuit to the light-emitting device.

DETAILED DESCRIPTION OF PREFERRED EMBODIMENTS

Figure 1:
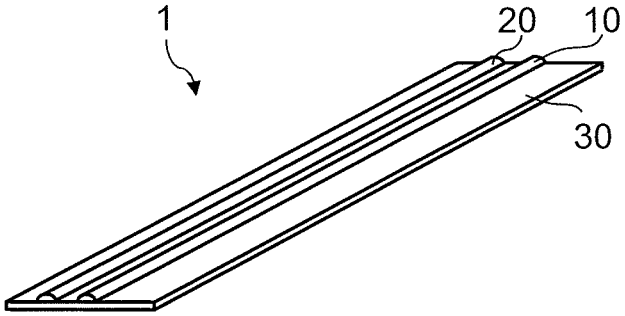
FIG. 1 is a schematic perspective view of an appearance of a light-emitting device in accordance with an exemplary embodiment.

A disadvantage of a conventional light-emitting device is described before description of an exemplary embodiment.

A light source for tunable lighting (e.g. LED bulb lamp) has recently been developed. For this purpose, multiple light sources (LED element arrays) with different color temperatures from each other are used.

For example, two LED element arrays with different color temperatures may be provided in one LED module (light-emitting device). In this case, two LED element arrays with different color temperatures are provided on one board, and they are independently driven for color tuning.

Alternatively, each of two LED modules has one LED element array with different color temperature from each other, and each of LED element arrays in LED modules is independently driven for color tuning.

In both cases, color is tuned by changing an amount (value) of power input to two LED element arrays. Therefore, separate power circuits for two LED element arrays are needed to independently drive two LED element arrays. In other words, two independent power circuits (power systems) are needed for driving two LED element arrays. If two power circuits are used, input power differs due to variations in characteristics of each power circuit. This causes varied colors.

Exemplary embodiments are described below with reference to drawings. The exemplary embodiments described herein are illustrative and not restrictive. It is apparent that values, shapes, materials, components, layout positions and connections of components, processes (steps), process sequences, and so on in the exemplary embodiments are therefore to be considered in all respects as illustrative and not restrictive.

Drawings are schematic views and may not be precisely illustrated. Same reference marks are given to practically same structures in the drawings to omit or simplify duplicate descriptions.

(Light-Emitting Device)

Figure 2:
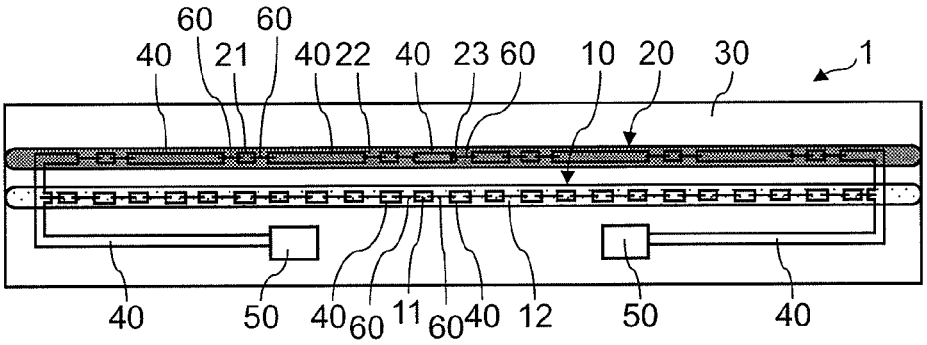
FIG. 2 is a plan view of the light-emitting device in FIG. 1.

A structure of light-emitting device 1 in the exemplary embodiment is described with reference to FIGS. 1 and 2. FIG. 1 is a schematic perspective view of an appearance of light-emitting device 1. FIG. 2 is a plan view of light-emitting device 1.

As shown in FIGS. 1 and 2, light-emitting device 1 is an LED module configured with LED. Light-emitting device 1 includes first light-emitting element 10 and second light-emitting element 20. First light-emitting element 10 includes first LED (first light-emitting diode) 11, and emits a first spectrum. Second light-emitting element 20 includes second LED (second light-emitting diode) 21 and constant voltage element 23 connected in series to second LED 21, and emits a second spectrum different from the first spectrum.

More specifically, a color temperature of the first spectrum emitted from first light-emitting element 10 is different from a color temperature (emission color) of the second spectrum emitted from second light-emitting element 20. It is preferable to configure such that the color temperature of second light-emitting element 20 is higher than the color temperature of the first spectrum. For example, the color temperature of the first spectrum, which has a low color temperature, is 2635K (x=0.47, y=0.42), and the color temperature of the second spectrum, which has a high color temperature, is 6075K (x=0.32, y=0.34). By setting a color temperature higher than that of the first spectrum to the second spectrum in this way, light emitted from light-emitting device 1 is tuned toward a low color temperature when power supplied to light-emitting device 1 is decreased. In other words, a color tuning similar to a filament bulb becomes feasible.

On the other hand, the color temperature of the first spectrum may be set higher than the color temperature of the second spectrum. By setting a color temperature lower than that of the first spectrum to the second spectrum, light emitted from light-emitting device 1 is tuned toward a high color temperature when the power supplied to light-emitting device 1 is decreased. In other words, since the light of high color temperature looks bright due to the Purkinje effect even in low illumination, the energy-saving effect can be achieved.

In light-emitting device 1, light-emitting device 1 can tune color by adjusting (color tuning) the light output ratio of first light-emitting element 10 and second light-emitting element 20. Details will be described later. In light-emitting device 1, first light-emitting element 10 and second light-emitting element 20 are connected in parallel. In addition, they are configured such that the line indicating the relation between the IF-VF of the first light-emitting element crosses with the line indicating that of the second light-emitting elements each other. This enables to change spectral distribution of light emitted from light-emitting device 1 just by changing power (DC current or DC voltage) supplied from the power circuit to light-emitting device 1 even if light-emitting device 1 has a structure that one power circuit is connected, i.e., only one power system for light-emitting device 1. In other words, required tuning can be achieved with a single power circuit.

Light-emitting device 1 further includes board 30, wiring 40 formed on board 30, electrode terminal 50 electrically connected to wiring 40, and wire 60. Light-emitting device 1 is an LED module with COB structure in which LED chips are directly mounted on board 30. Each component of light-emitting device 1 is detailed below.

[First Light-Emitting Element]

First light-emitting element 10 is provided on board 30. First light-emitting element 10 emits light of the first spectrum. For example, the color temperature is set to 2635 K (x=0.47, y=0.42).

First light-emitting element 10 includes multiple first LEDs 11 and first sealing member 12 for sealing first LEDs 11. First sealing member 12 contains phosphor as a wavelength conversion material. With respect to lights emitted from first LEDs 11, first light-emitting element 10 emits a mixed light of color-converted (wavelength converted) light and non-converted light. First light-emitting element 10 is linearly configured, and is a first linear light source in light-emitting device 1.

An example shows first light-emitting element 10 configured as a light-emitting element array having multiple first LEDs 11. However, first light-emitting element 10 may at least have one first LED 11. In first light-emitting element 10 shown in FIG. 2, twelve first LEDs 11, each having forward voltage (VF) of about 3V, are provided.

First LEDs 11 are mounted on board 30. For example, multiple first LEDs 11 are aligned linearly (one straight line) in a row in the longer direction of board 30. Multiple first LEDs 11 are also electrically connected in series to wiring 40 and wire 60.

First LEDs 11 are an example of the semiconductor light-emitting element, and emit light by applying predetermined DC power. Each of first LEDs 11 is a bare chip that emits monochrome visible light. For example, a blue LED chip that emits blue light when power is applied is used. The blue LED chip is, for example, configured with InGaN system material, and a gallium-nitride semiconductor light-emitting element having center wavelength of not less than 440 nm and not greater than 470 nm can be used.

Each of first LEDs 11 is electrically connected to wiring 40 by wire 60. For example, a p-side electrode and n-side electrode are formed on the top face of chip of first LED 11 for supplying DC power. The p-side electrode and one wire connector of each of wirings 40 are bonded by wire 60. In the same way, the n-side electrode and another one wire connector of each of wirings 40 are bonded by wire 60. Or, adjacent first LEDs 11 may be directly connected by wire 60 (so-called chip-to-chip connection) without wiring 40 (wire connector).

First sealing member 12 is formed on board 30 such that first sealing member 12 covers first LEDs 11. By covering first LEDs 11 by first sealing member 12, first LEDs 11 can be protected. First sealing member 12 is formed such that multiple first LEDs 11 aligned in a row are integrally sealed. In other words, first sealing member 12 is linearly formed to cover all first LEDs 11 in the direction that first LEDs 11 are aligned (alignment direction).

First sealing member 12 is configured mainly with translucent material. To convert the wavelength of the light of first LED 11 to a predetermined wavelength, a wavelength conversion material is mixed in first sealing member 12 (translucent material). For example, first sealing member 12 contains phosphor as the wavelength conversion material, and this also functions as a wavelength conversion member for converting the luminous wavelength (color) of first LED 11. For this first sealing member 12, an insulating resin material containing phosphor particles (resin containing phosphor) may be used. The phosphor particles are excited by light emissions from first LEDs 11, and emit light in a required color (wavelength).

As a resin material configuring first sealing member 12, for example, silicon resin can be used. Or, a light diffusion material may be dispersed in first sealing member 12. First sealing member 12 may also be formed of inorganic materials, such as low-melting-point glass and sol-gel glass, in addition to organic materials such as fluorine resin.

Still more, as phosphor particles, for example, YAG (yttrium aluminum garnet) yellow-phosphor particles can be used when first LEDs 11 are blue LEDs that emit blue light. As a light diffusion material, silica particles, for example, are used.

In other words, first sealing member 12 is resin containing phosphor, in which predetermined yellow phosphor particles are dispersed in silicone resin. The resin containing phosphor is applied to the surface of board 30, using a dispenser, so as to integrally seal all first LEDs 11. Then, the resin containing phosphor is cured to form first sealing member 12. In this case, the shape of first sealing member 12 is cylindrical, and its cross section perpendicular to the longer direction of first sealing member 12 is substantially semicircle.

[Second Light-Emitting Element]

Second light-emitting element 20 is provided on board 30. Second light-emitting element 20 emits light of the second spectrum. For example, the color temperature is set to 6075 K (x=0.32, y=0.34). As described above, the color temperature of the second spectrum is set higher than that of the first spectrum. Larger the difference between color temperatures of the first spectrum and the second spectrum is, broader the tunable color temperature range. In other words, although a difference in current values of both spectrums is small, the color temperature can be adjusted in a sufficient range. For example, the difference in color temperatures is preferably 3000 K or above. Current values and color tunable range are described later. On the other hand, the color temperature difference is preferably 12000 K or below because a change of light flux becomes too large if the color temperature difference is too large. The color temperature difference between the first spectrum and second spectrum is 3440 K in light-emitting device 1. To achieve the color temperature difference within this range, the first light-emitting spectrum is preferably not less than 2000 K and not greater than 3000 K. The color temperature of the second spectrum is preferably not less than 5500 K and not greater than 14000 K.

Second light-emitting element 20 includes multiple second LEDs 21, constant voltage element 23, and second sealing member 22 for sealing second LEDs 21 and constant voltage element 23. Second sealing member 22 also contains phosphor that is a wavelength conversion material. With respect to light emitted from second LEDs 21, second light-emitting element 20 emits a mixed light of color-converted (wavelength-converted) light and non-converted light. Second light-emitting element 20 is linearly configured, and is a second linear light source in light-emitting device 1.

In the example, second light-emitting device 20 is also configured as a light-emitting element array having multiple second LEDs 21. However, second light-emitting element 20 may at least have one second LED 21. In second light-emitting element 20 shown in FIG. 2, six second LEDs 21, each having forward voltage (VF) of about 3V, are provided.

Second LEDs 21 are mounted on board 30. For example, second LEDs 21 are linearly (one straight line) aligned in a row in parallel with an element row of first LEDs 11. Second LEDs 21 are also electrically connected in series by wiring 40 and wire 60.

Second LEDs 21 are an example of the semiconductor light-emitting element, and they emit light by applying predetermined DC power. Each of second LEDs 21 is a bare chip that emits monochrome visible light. Same as first LEDs 11, a blue LED chip, for example, is used.

Each of second LEDs 21 is electrically connected to wiring 40 by wire 60. Same as first LEDs 11, second LEDs 21 and a wire connector of wiring 40 are typically bonded, using wire 60. Second LEDs 21 may also adopt chip-to-chip connection.

LED chips with different center wavelengths (color temperatures) may be used for first LEDs 11 and second LEDs 21, respectively. In other words, the color temperature of first LEDs 11 and the color temperature of second LEDs 21 may be different.

Second sealing member 22 is formed on board 30 such that it covers second LEDs 21 and constant voltage element 23. By covering second LEDs 21 and constant voltage element 23 with second sealing member 22, second LEDs 21 and constant voltage element 23 can be protected. Second sealing member 22 is formed such that it integrally seals multiple second LEDs 21 aligned in a row and constant voltage element 23. In other words, second sealing member 22 is formed in a straight line to cover all second LEDs 21 and constant voltage element 23 in a direction that second LEDs 21 and constant voltage element 23 are arranged (alignment direction).

Second sealing member 22 is configured mainly with translucent material. To convert the wavelength of light of second LED 21 to a predetermined wavelength, a wavelength conversion material is mixed to second sealing member 22 (translucent material), same as first sealing member 12. In this case, the material and formation method of first sealing member 12 can be used for material and formation method of second sealing member 22.

However, the color temperature (spectrum) of light emitted from first light-emitting element 10 (first sealing member 12) and the color temperature (spectrum) of light emitted from second light-emitting element 20 (second sealing member 22) are preferably different. Therefore, type and amount of phosphor particles contained in first sealing member 12 and second sealing member 22 are changed. This is same for the case of using LED chips with same center wavelength or LED chips with different center wavelengths for first light-emitting element 10 and second light-emitting element 20.

Constant voltage element 23 is an element with a characteristic for maintaining a constant voltage at both ends of the element relative to a change of load current. For example, a zener diode (ZD) can be used. As an example, a zener diode whose breakdown voltage (zener voltage) is 18.5 V is used in light-emitting device 1. Other than zener diodes, a varistor can also be used for constant voltage element 23.

In light-emitting device 1, constant voltage element 23, which is the zener diode, is connected such that reverse bias voltage is applied. In addition, constant voltage element 23 is connected in series to second LEDs 21. Constant voltage element 23 is mounted on board 30, and is linearly aligned (straight line) together with second LEDs 21.

[Board]

Board 30 is a mounting board for mounting first LEDs 11, second LEDs 21, and constant voltage element 23. A resin board, ceramic board, metal board, or glass substrate can be used for board 30.

As a resin board, for example, a glass epoxy board containing glass fiber and epoxy resin, a board containing paper phenol or paper epoxy, or a flexible board configured typically with polyimide can be used. As a ceramic board, an alumina substrate made of alumina (e.g., white polycrystal alumina substrate) or an aluminum nitride substrate can be used. As a metal board, for example, an aluminum-alloy board, iron-alloy board, or copper-alloy board, on which an insulating film is formed, can be used. In addition, a both-sided circuit board with a thin copper film on both faces of resin board can be used. Board 30 may be translucent or non-translucent board.

In addition, for example, a long rectangular board may be used for board 30. However, the shape of board 30 is neither limited to rectangular nor long shape.

[Wiring]

Wiring 40 supplies power to the circuit elements (first LEDs 11, second LEDs 21, and constant voltage element 23) mounted on board 30. Wiring 40 is formed in a predetermined pattern on the surface of board 30. Accordingly, wiring 40 is electrically connected to first LEDs 11, second LEDs 21, and constant voltage element 23.

For example, by changing the pattern (shape) of wiring 40, as required, adjacent first LEDs 11 or adjacent second LEDs 21 can be electrically connected, first LED 11 or second LED 21 and electrode terminal 50 can be electrically connected, or second LED 21 and constant voltage element 23 can be electrically connected.

Wiring 40 is configured with a conductive member, such as metal. As wiring 40, for example, metal wiring, such as silver wiring or copper wiring, can be used. In addition, silver-coated wiring, in which silver is used as base metal for plating, may be used as wiring 40.

Still more, wiring 40 is preferably coated by an insulating film. In this case, an insulating resin film or glass-coating film, such as reflective and insulative resist, can be used as the insulating film. For example, as the insulating film, a highly-reflective white resin material with reflectivity of about 98% (white resist) can be used. To connect wiring 40 and first LEDs 11 or second LEDs 21 using wire 60, an opening is provided in the insulating film to expose a part of wiring 40 as a wire connector (land). The insulating film is formed on the entire surface of board 30, except for this opening.

By coating entire board 30 with the insulating film, such as white resist and glass-coating film, lights emitted from first light-emitting element 10 (first LEDs 11 and first sealing member 12) and second light-emitting element 20 (second LEDs 21 and second sealing member 22) can be reflected. As a result, light extraction efficiency of light-emitting device 1 can be improved. Moreover, coating of wiring 40 with the insulating film can improve insulation properties (withstanding properties) of board 30. Furthermore, oxidization of wiring 40 can be suppressed.

[Electrode Terminal]

Electrode terminal 50 is an external connection terminal (connector) for receiving power typically from an external power source (power circuit) to supply power to first LEDs 11, second LEDs 21, and constant voltage element 23. A pair of electrode terminals 50 is provided, and one electrode terminal 50 is a high-voltage electrode terminal. The other electrode terminal 50 is a low-voltage electrode terminal.

By supplying power from the external power source to electrode terminals 50, power is supplied to first LEDs 11, second LEDs 21, and constant voltage element 23 via wiring 40 and wire 60. For example, by connecting a constant current source to electrode terminal 50, DC current is supplied to first LEDs 11, second LEDs 21 and constant voltage element 23.

Electrode terminal 50 is a socket, and includes a resin cover and a conductor (conductive pin) for receiving DC power (both not illustrated). The conductor is electrically connected to wiring 40 formed on board 30. The other end of connector line (harness), whose one end is connected typically to the external power source, is fitted to the socket. This enables electrode terminal 50 to receive power from the external power source via the connector line.

Instead of the socket, electrode terminal 50 may also be a metal electrode (metal terminal) configured with, for example, gold patterned in a rectangular shape.

To electrically connect multiple light-emitting devices 1, for example, electrode terminal 50 of one light-emitting device 1 and electrode terminal 50 of the other light-emitting device 1 are connected, using a connector line or lead wire.

[Wire]

Wire 60 is an electric wire for electrically connecting circuit elements (first LEDs 11, second LEDs 21, and constant voltage element 23) and wiring 40. For example, wire 60 is configured with a gold wire. Wire 60 is stretched in a direction same as the straight direction of first sealing member 12 (second sealing member 22). In other words, all wires 60 in first light-emitting element 10 and second light-emitting element 20 are provided on the straight line in a plan view.

[Operation]

Figure 3:
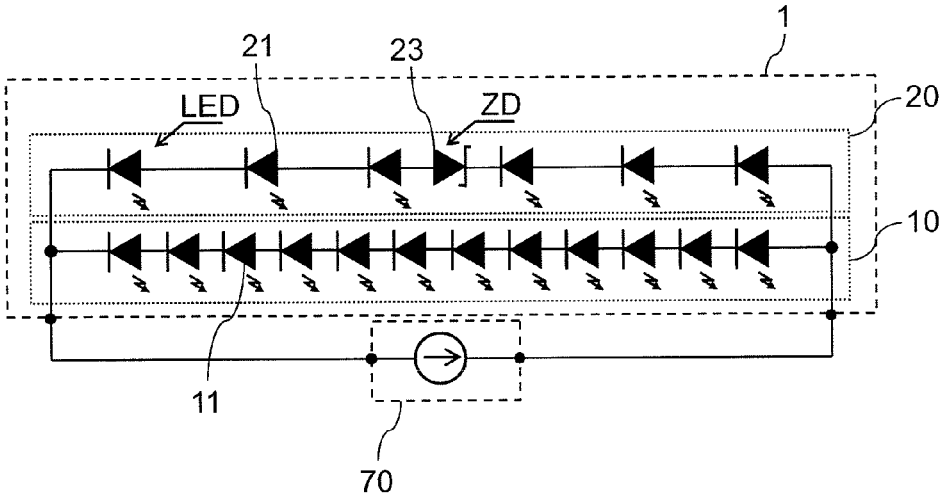
FIG. 3 is a circuit diagram of the light-emitting device in FIG. 1.
Figure 4:
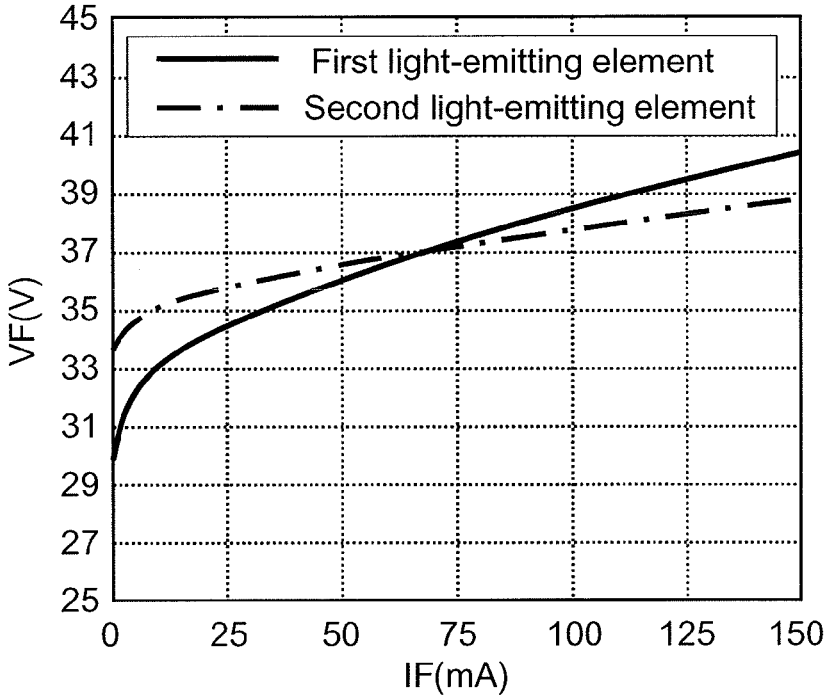
FIG. 4 illustrates IF-VF characteristics of a first light-emitting element and a second light-emitting element in the light-emitting device in FIG. 1.
Figure 5:
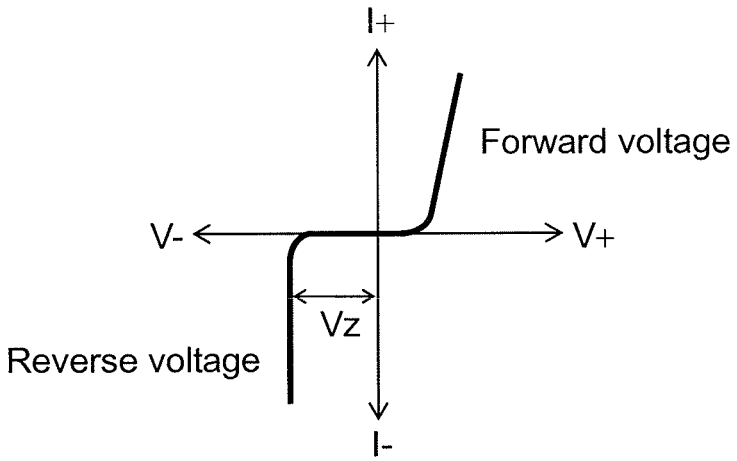
FIG. 5 is an IV characteristic of a zener diode of the light-emitting device in FIG. 1.

Next, the operation of light-emitting device 1 is described with reference to FIGS. 3 to 5. FIG. 3 is a circuit diagram of light-emitting device 1. FIG. 4 illustrates IF-VF characteristics of first light-emitting element 10 and second light-emitting element 20 in light-emitting device 1. FIG. 5 illustrates an IV characteristic of the zener diode.

As shown in FIG. 3, first light-emitting element 10 and second light-emitting element 20 are connected in parallel in light-emitting device 1. First light-emitting element 10 is configured by connecting in series twelve first LEDs 11 having forward voltage VF of about 3V, respectively. Second light-emitting element 20 is configured by connecting in series six second LEDs 21, each having forward voltage VF of about 3V, and one zener diode (constant voltage element 23) having breakdown voltage Vz of 18.5 V.

Light-emitting device 1 is connected to one power system. As shown in FIG. 3, light-emitting device 1 is connected, for example, to power circuit 70 having constant current source. However, power circuit 70 is not limited to the constant current source.

As shown in FIG. 4, the IF-VF characteristic of first light-emitting element 10 is obtained by twelve first LEDs 11 connected in series. On the other hand, the IF-VF characteristic of second light-emitting element 20 is a characteristic in which breakdown voltage Vz of the zener diode is added to the IF-VF characteristic of six second LEDs 21. Accordingly, the IF-VF characteristic of second light-emitting element 20 includes the characteristic of breakdown voltage Vz of the zener diode shown in FIG. 5. The VF at an intersection of lines indicating the IF-VF characteristics of the first light-emitting element and the second light-emitting element is 36.5 V. A proportion of breakdown voltage Vz (=18.5 V) of the zener diode (constant voltage element 23) in VF at the intersection is 51%.

First light-emitting element 10 and second light-emitting element 20 are configured such that lines indicating their IF-VF characteristics cross each other. In other words, a slope of the line indicating the IF-VF characteristic of first light-emitting device 10 and a slope of the line indicating the IF-VF characteristic of second light-emitting element 20 are set to become different. This makes two lines indicating the IF-VF characteristics cross each other. Accordingly, a proportion (slope of the line indicating the IF-VF characteristic) of a change of forward voltage (VF) relative to a change of forward current (IF) can be made different between first light-emitting element 10 and second light-emitting element 20.

In the slopes of the lines indicating the IF-VF characteristics, the slope of second light-emitting element 20 including the zener diode is smaller than the slope of first light-emitting element 10. More specifically, second light-emitting device 20 has a smaller change in the forward voltage than that of first light-emitting element 10 with respect to a change of forward voltage relative to a change of forward current. In other words, second light-emitting element 20 has a larger change than that of first light-emitting element 10 with respect to a change of forward current relative to a change of forward voltage.

First light-emitting element 10 and second light-emitting element 20 having the above IF-VF characteristics are connected in parallel. This enables to change a proportion of current fed to first light-emitting element 10 and second light-emitting element 20 just by changing the current input to light-emitting device 1. In other words, the distribution rate of forward current can be adjusted (controlled) between first light-emitting element 10 and second light-emitting element 20 connected in parallel, corresponding to the power input to light-emitting device 1.

This operation is detailed below with reference to FIG. 4.

Power circuit 70 is a constant current source. For example, current supplied from power circuit 70 to first light-emitting element 10 and second light-emitting element 20 is matched to the intersection of two IF-VF characteristics (IF≈70 mA, VF≈36.5 V). In this case, the same forward current, about 70 mA, is supplied to first light-emitting element 10 and second light-emitting element 20, respectively. This means about 140 mA (about 70 mA+about 70 mA) of power is supplied from power circuit 70. Voltage applied to first light-emitting element 10 and second light-emitting element 20 is voltage at the above intersection, which is about 36.5 V.

When current higher than that at the aforementioned intersection is supplied to first light-emitting element 10 and second light-emitting element 20, i.e., when 70 mA or more is supplied to each element (the current supplied from power circuit 70 is 140 mA or more), the line indicating the IF-VF characteristic of first light-emitting element 10 is above the line indicating the IF-VF characteristic of second light-emitting element 20. Since these elements are connected in parallel, the same voltage is applied. Therefore, the current running to first light-emitting element 10 becomes smaller than the current running to second light-emitting element 20.

Let's say, the total current of about 210 mA is supplied from power circuit 70 to first light-emitting element 10 and second light-emitting element 20. In this case, the current is branched and about 85 mA of current runs to first light-emitting element 10 and current of about 125 mA to second light-emitting element 20. The same voltage of about 38V is applied to both elements.

When current lower than that at the aforementioned intersection is supplied to first light-emitting element 10 and second light-emitting element 20, i.e., when 70 mA or less is supplied to each element (the current supplied from power circuit 70 is 140 mA or less), the line indicating the IF-VF characteristic of second light-emitting element 20 is above the line indicating the IF-VF characteristic of first light-emitting element 10. Since these elements are connected in parallel, the same voltage is applied. Therefore, the current running to first light-emitting element 10 becomes larger than the current running to second light-emitting element 20.

Let's say, the total current of about 45 mA is supplied from power circuit 70 to first light-emitting element 10 and second light-emitting element 20. In this case, the current is branched and about 35 mA of current runs to first light-emitting element 10 and current of about 10 mA to second light-emitting element 20. The same voltage of about 35V is applied to both elements.

A current value at the intersection of lines indicating the IF-IV characteristics of first light-emitting element 10 and second light-emitting element 20 is set as a reference. An amount of current running to second light-emitting element 20 can be made larger than that to first light-emitting element 10 by increasing the amount of current input to light-emitting device 1. In other words, a proportion of current to second light-emitting element 20 can be increased.

In the same way, the amount of current running to first light-emitting element 10 can be made larger than that to second light-emitting element 20 by decreasing current input to light-emitting device 1. In other words, a proportion of current to first light-emitting element 10 can be increased.

In this way, a proportion of current running to first light-emitting element 10 and second light-emitting element 20 can be relatively changed by changing the amount of current input to light-emitting device 1. This can change the light output ratio of first light-emitting element 10 (first LEDs 11) and second light-emitting element 20 (second LEDs 21).

For example, when current supplied from power circuit 70 to light-emitting device 1 is changed in the above range, the color temperature of mixed light of those from first light-emitting element 10 and second light-emitting element 20 is 2900 K at 45 mA, 3570 K at 140 mA, and 3870 K at 210 mA. A single power source enables to change the color temperature from 2900 K to 3870 K.

If the first spectrum is set to have the color temperature lower than that of the second spectrum, power supplied to first light-emitting element 10 increases more than that to second light-emitting element 20 when power supplied to light-emitting device 1 decreases. Accordingly, the light emitted from light-emitting device 1 is tuned toward lower color temperature. In other words, a tuning control similar to a filament bulb becomes feasible.

On the other hand, the color temperature of the first spectrum may be set higher than the color temperature of the second spectrum. When power supplied to light-emitting device 1 is decreased, power supplied to first light-emitting element 10 becomes greater than that to second light-emitting element 20. Accordingly, light emitted from light-emitting device 1 is tuned toward higher color temperature. In other words, the light at high color temperature looks bright due to the Purkinje effect even in low illumination. Effects including energy conservation can thus be achieved.

Figure 6:
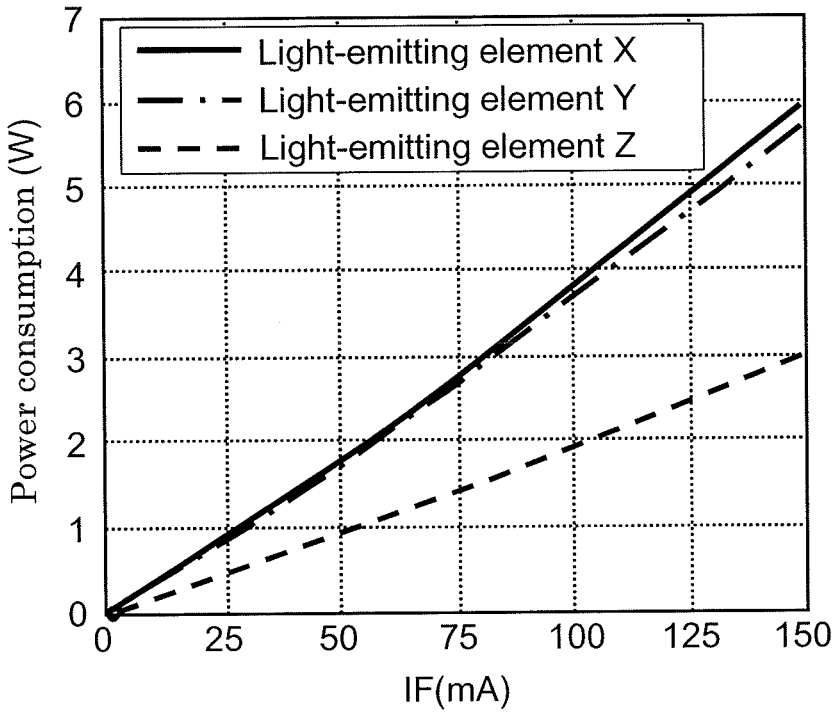
FIG. 6 shows a loss due to the zener diode of the light-emitting device in FIG. 1, illustrating a relationship of forward current and a power consumption in each independent circuit of light-emitting element X (twelve series connection/without ZD), light-emitting element Y (six series connection/with ZD), and light-emitting element Z (six series connection/without ZD).

Next, a loss of constant voltage element (zener diode) 23 in second light-emitting element 20 is described with reference to FIGS. 6 to 13. FIG. 6 illustrates a loss due to the zener diode. It shows a relationship of the forward current and power consumption in each independent circuit of light-emitting element X (twelve series connections/without ZD), light-emitting element Y (six series connections/with ZD), and light-emitting element Z (six series connections/without ZD).

Light-emitting element X is equivalent to first light-emitting element 10, and configured with twelve LEDs (VF=about 3V) connected in series. Light-emitting element Y is equivalent to second light-emitting element 20, and configured with six LEDs (VF=about 3V) connected in series and one zener diode (Vz=18.5 V). Light-emitting element Z is configured with six LEDs (VF: about 3V) connected in series.

As shown in FIG. 6, light-emitting element X and light-emitting element Z do not include the zener diode, and thus there is no loss by the zener diode. On the other hand, a loss due to the zener diode occurs in light-emitting element Y, which is apparent when compared with light-emitting element X.

Figure 7:
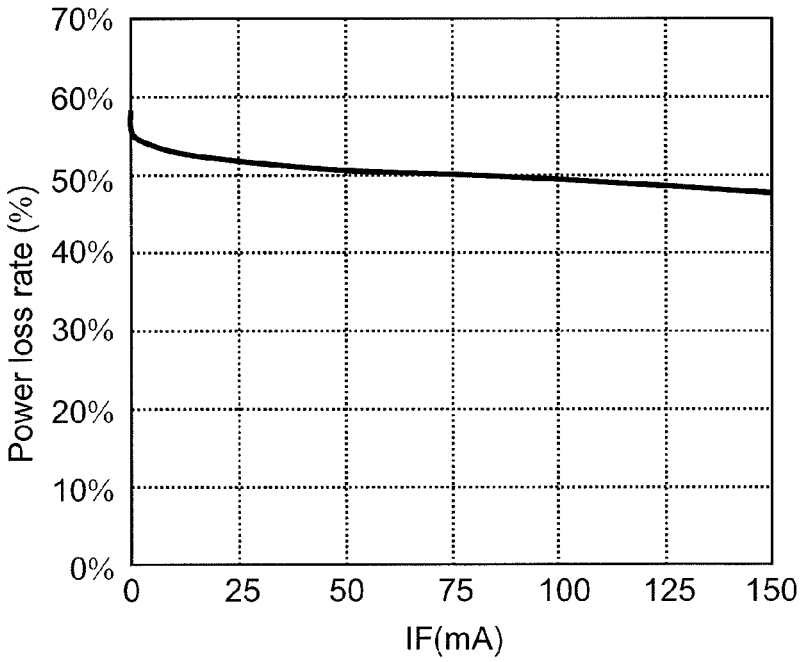
FIG. 7 illustrates a relationship of forward current and a power loss rate of the zener diode in an independent circuit of light-emitting element Y (six series connection/with ZD).

FIG. 7 shows results of calculation of loss rate by the zener diode in light-emitting element Y. FIG. 7 shows a relationship of the forward current and power loss rate of zener diode in the independent circuit of light-emitting element Y.

As shown in FIG. 7, the power loss rate changes depending on a change of the forward current by including the zener diode in the light-emitting element. In other words, the loss rate due to the zener diode changes depending on a change of the forward current.

Next, a loss by a circuit in which aforementioned light-emitting element X and light-emitting element Y are connected in parallel is described with reference to FIGS. 8 and 9.

Figure 8:
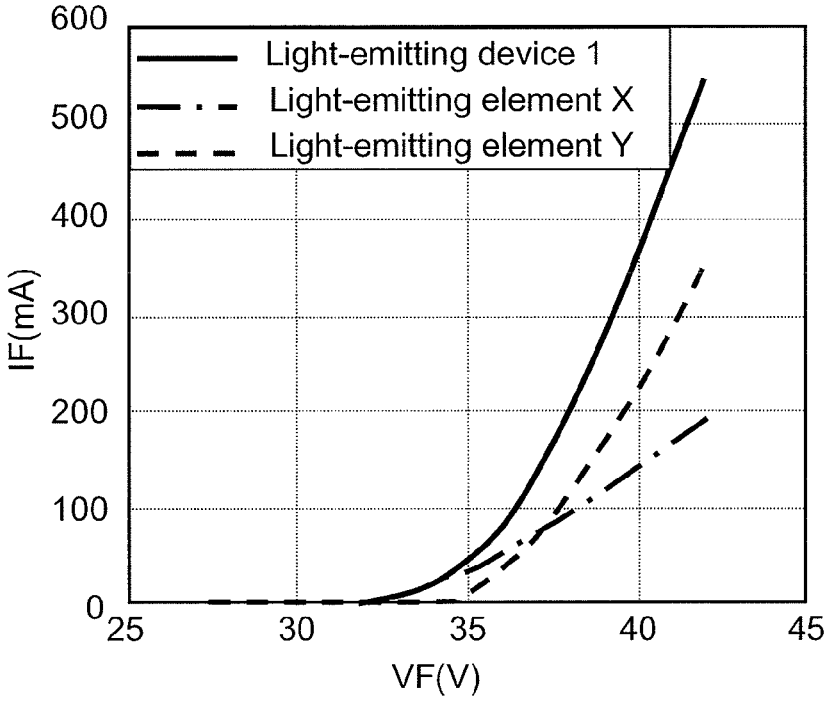
FIG. 8 illustrates the VF-IF characteristic in each of the independent circuit of light-emitting element X (twelve series connection/without ZD), independent circuit of light-emitting element Y (six series connection/with ZD), and a circuit in which light-emitting element X and light-emitting element Y are connected in parallel (equivalent to the light-emitting device in FIG. 1).

FIG. 8 shows the VF-IF characteristic of each of an independent circuit of light-emitting element X (twelve series connections/without ZD) and light-emitting element Y (six series connections/with ZD), and a circuit in which light-emitting element X and light-emitting element Y are connected in parallel (equivalent to light-emitting device 1).

Figure 9:
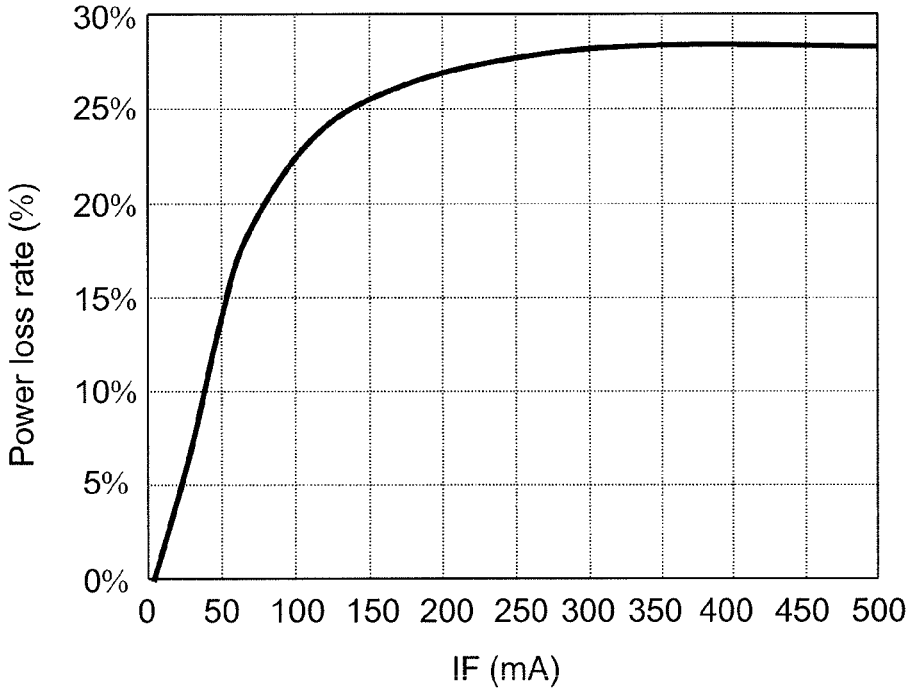
FIG. 9 illustrates a relationship of forward current and a power loss rate of the zener diode in a circuit in which light-emitting element X (twelve series connection/without ZD) and light-emitting element Y (six series connection/with ZD) are connected in parallel.

FIG. 9 shows results of calculation of loss rate by the zener diode in the circuit in which light-emitting element X and light-emitting element Y are connected in parallel. FIG. 9 shows a relationship of the forward current and a power loss rate of the zener diode in the circuit in which light-emitting element X and light-emitting element Y are connected in parallel. The power loss rate indicates a proportion of power consumption by the zener diode relative to power consumption by each light-emitting device when the circuit in which light-emitting element X and light-emitting element Y are connected in parallel is set as one light-emitting device (module).

As shown in FIG. 9, in the circuit in which light-emitting element X and light-emitting element Y are connected in parallel, a power loss rate changes depending on a change of the forward current. In other words, a proportion of loss due to the zener diode changes depending on a change of the forward current.

Based on results shown in FIGS. 6 to 9, a loss by the zener diode can be suppressed by reducing a proportion of breakdown voltage (Vz) of zener diode relative to the forward voltage (VF) of LED. On the other hand, however, the current rate becomes difficult to be changed broadly due to a small difference in the IF-VF characteristic. In other words, it becomes difficult to greatly change the rate of current running to first light-emitting element 10 and second light-emitting element 20 relative to the current input to light-emitting device 1.

Next is described an influence of loss by the zener diode when the number of LEDs and the breakdown voltage of zener diode are changed in second light-emitting element (light-emitting element Y) 20 with reference to FIGS. 10 to 13.

Figure 10:
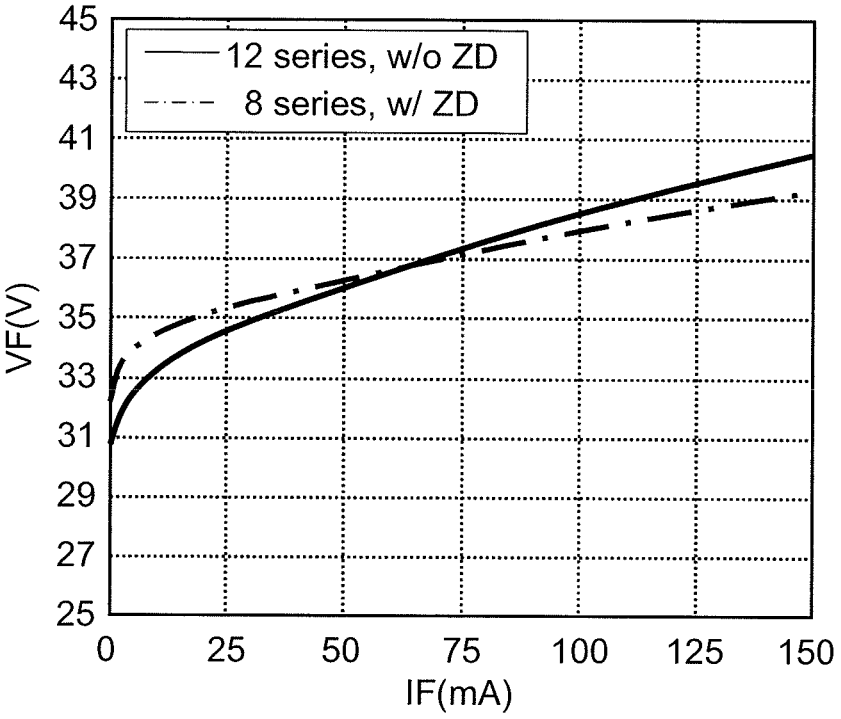
FIG. 10 illustrates the IF-VF characteristic of the light-emitting device when the first light-emitting element (twelve series connection/without ZD) and second light-emitting element (eight series connection/with ZD) are connected in parallel in the light-emitting device in accordance with the exemplary embodiment.

FIG. 10 shows the IF-VF characteristic of each of the light-emitting devices when first light-emitting element 10 configured with twelve LEDs (VF=about 3V) and second light-emitting element 20 configured with eight LEDs (VF=about 3V) connected in series and one zener diode (Vz=12.3V) are connected in parallel. In other words, in the light-emitting device with the characteristic shown in FIG. 10, the number of LEDs is changed from six to eight, and the breakdown voltage of zener diode is changed from 18.5 V to 12.3 V relative to second light-emitting element 20 in light-emitting device 1 with the characteristic shown in FIG. 4. The structure of first light-emitting element 10 is same in both light-emitting devices. VF at a point where two lines indicating the IF-VF characteristics of the first light-emitting element and the second light-emitting element cross each other is 36.2 V. A proportion of breakdown voltage Vz (=12.3 V) of the zener diode (constant voltage element 23) relative to VF at the intersection is 34%.

As shown in FIG. 10, a rate of change of current ratio of first light-emitting element 10 and second light-emitting element 20 relative to a change of amount of current input to the light-emitting device is smaller in this light-emitting device than that in light-emitting device 1 having the characteristic shown in FIG. 4.

Figure 11:
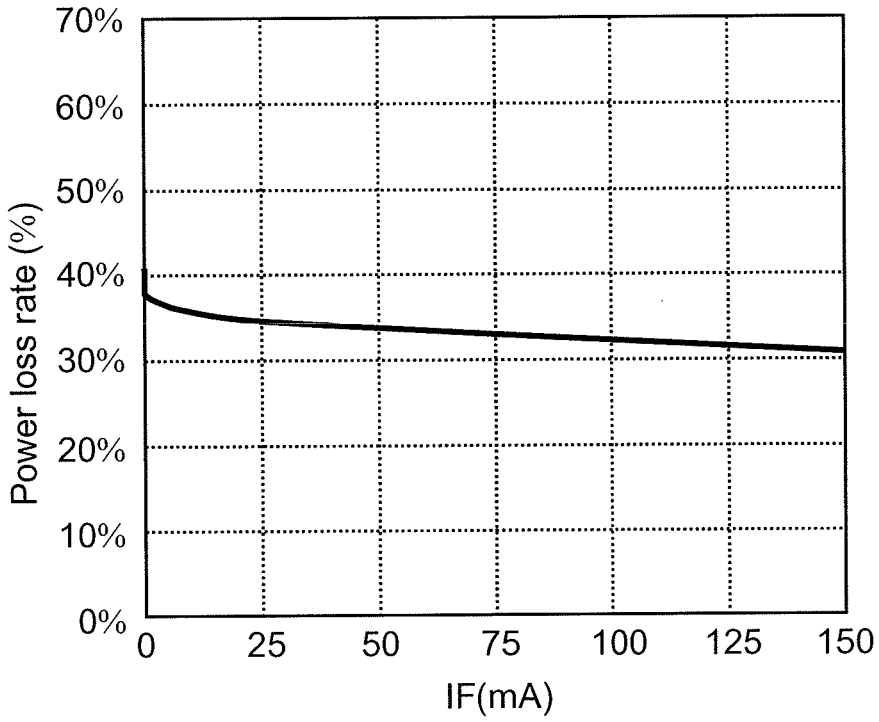
FIG. 11 illustrates a relationship of forward current and a power loss rate of the zener diode in the light-emitting device having the characteristic in FIG. 10.

FIG. 11 shows, same as FIG. 7, results of calculation of loss rate by the zener diode in the light-emitting device having the characteristic shown in FIG. 10. FIG. 11 shows a relationship of the forward current and a power loss rate of the zener diode in the light-emitting device having the characteristic shown in FIG. 10.

As shown in FIG. 11, a power loss rate in the light-emitting device having the characteristic shown in FIG. 10 is reduced, compared to the power loss rate in light-emitting device 1 having the characteristic shown in FIG. 7. This is because a proportion of the forward voltage in LEDs is high relative to the breakdown voltage of the zener diode in the light-emitting device having the characteristic shown in FIG. 10, compared to light-emitting device 1 having the characteristic shown in FIG. 4. Accordingly, it would appear that a loss rate by the zener diode has reduced.

Figure 12:
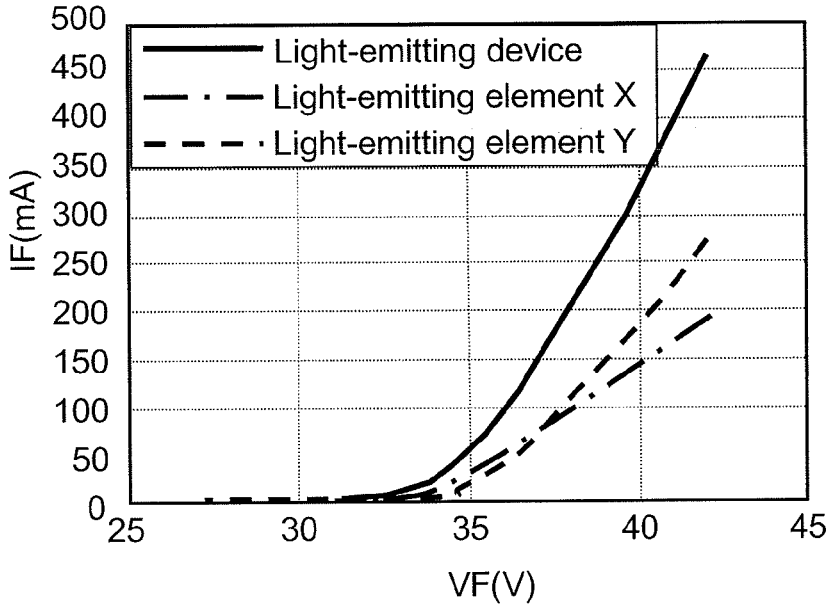
FIG. 12 illustrates the VF-IF characteristic in each of the independent circuit of the first light-emitting element (twelve series connection/without ZD), independent circuit of the second light-emitting element (eight series connection/with ZD), and a circuit in which the first light-emitting element and the second light-emitting element are connected in parallel in the light-emitting device having the characteristic in FIG. 10.

FIG. 12 shows the VF-IF characteristic of the independent circuit of first light-emitting element (twelve series connections/without ZD) 10, the independent circuit of second light-emitting element (eight series connections/with ZD), and the circuit in which first light-emitting element 10 and second light-emitting element 20 are connected in parallel.

Figure 13:
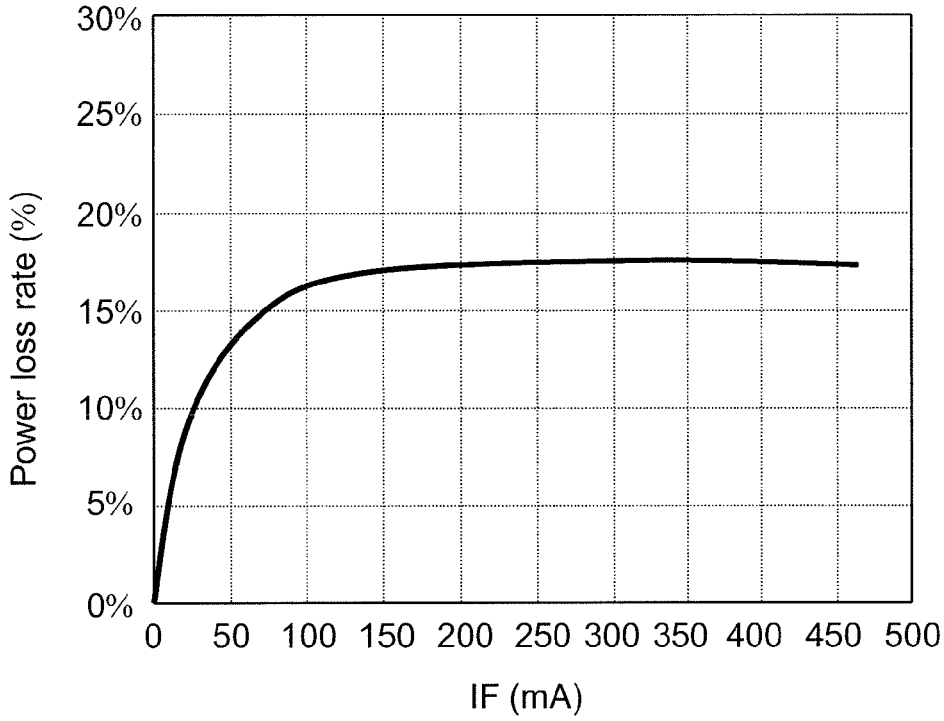
FIG. 13 illustrates a relationship of forward current and a power loss rate of the zener diode in the circuit of the light-emitting device having the characteristic in FIG. 10.

Same as FIG. 9, FIG. 13 shows results of calculation of a loss rate due to the zener diode in the circuits of light-emitting devices having the characteristics shown in FIGS. 10 to 12. FIG. 13 shows a relationship of the forward current and power loss rate by the zener diode in the circuit of the light-emitting device having the characteristic shown in FIG. 10.

As shown in FIGS. 13 and 9, a power loss rate has reduced in the light-emitting device having the characteristic shown in FIG. 10, compared to the light-emitting device having the characteristic shown in FIG. 4. In other words, the loss rate due to the zener diode relative to the forward current is reduced Based on the results shown in FIGS. 10 to 13, the light output ratios of both first light-emitting element and second light-emitting element need to be the same in order to tune colors in the same way in light-emitting device 1 having the characteristic shown in FIG. 4 and the light-emitting device having the characteristic shown in FIG. 10. In other words, the elements need to be adjusted to achieve the same current distribution rate in both elements. Therefore, the amount of current input to the light-emitting device having the characteristic shown in FIG. 10 needs to be changed more than that to the light-emitting device having the characteristic shown in FIG. 4. However, the color temperature can also be adjusted within a range same as that of light-emitting device 1 by setting a color temperature difference between the first spectrum and the second spectrum in the light-emitting device shown in FIG. 10 greater than that in light-emitting device 1. The light-emitting device having the characteristic shown in FIG. 10 can reduce a loss by the zener diode, compared to light-emitting device 1 shown in FIG. 4. More specifically, the light-emitting device having the characteristic shown in FIG. 10 can reduce a power loss due to the zener diode from 28% to 17%, compared to light-emitting device 1 having the characteristic shown in FIG. 4.

Accordingly, the loss by the zener diode can be changed by changing the combination of the number of LEDs (forward voltage) in second light-emitting element 20 including the zener diode and breakdown voltage Vz of the zener diode.

A proportion of breakdown voltage Vz of the zener diode (constant voltage element 23) relative to VF at the intersection of lines indicating the IF-VF characteristics of the first light-emitting element and the second light-emitting element is preferably not less than 34% and not greater than 51%. This enables to suppress the loss due to the zener diode to 30% or less and also enables tuning.

As described above, first light-emitting element 10 including first LEDs 11 and second light-emitting element 20 including second LEDs 21 connected in series and constant voltage element 23 are connected in parallel in light-emitting device 1. In addition, the lines indicating the IF-VF characteristics of first light-emitting element 10 and second light-emitting element 20 cross each other.

In this structure, a ratio of current running to first light-emitting element 10 and second light-emitting element 20 can be changed by changing the amount of current input to light-emitting device 1. This changes a light output ratio of first light-emitting element 10 (first LEDs 11) and second light-emitting element 20 (second LEDs 21), and lights are tuned. Accordingly, light-emitting device 1 enables to change spectral distribution to achieve required tuning just by connecting a single power circuit (power system) to light-emitting device 1 and changing the current supplied from the power circuit to light-emitting device 1.

Conventionally, two light-emitting devices (or two light-emitting element arrays) with different color temperatures (light colors) are driven independently from each other. In this case, two power circuits (power systems) are needed to drive each device independently. Since the input current differs due to variations in characteristics of each power circuit, color variations occur.

In contrast, in light-emitting device 1, current running to each of the two light-emitting elements with different color temperatures can be changed by single power circuit. Accordingly, aforementioned color variations do not occur.

Still more, two light-emitting elements with different color temperatures are provided in one light-emitting device in light-emitting device 1. Therefore, color is tunable by single light-emitting device. This enables to suppress enlargement of apparatuses, such as light source for lighting and lighting apparatus, when the light-emitting device is assembled in apparatuses, compared to the case of using two light-emitting devices with different color temperatures.

Still more, when the light-emitting device is used as a linear light source, color separation may become noticeable if two light-emitting devices with different color temperatures are aligned and assembled in apparatuses, such as light source for lighting and lighting apparatus.

In contrast, in light-emitting device 1, since two light-emitting elements with different color temperatures are provided close to each other in single light-emitting device, color separation can be suppressed.

Still more, four or more electrode terminals (power supply units) are conventionally needed in one light-emitting device in a tunable light-emitting device in which two linear light sources with difference color temperatures are provided in one light-emitting device. Therefore, multiple completely independent lead wires are needed just for connecting adjacent light-emitting devices when multiple light-emitting devices are aligned in the longer direction and electrically connected. Or, power circuits are needed for the number of light-emitting devices. This requires a vast space for placement.

In contrast, light-emitting device 1 just requires two electrode terminals (power feeder) for one light-emitting device 1. Even if multiple light-emitting devices 1 are connected, they can be connected using a small number of lead wires. In addition, since only one power circuit is needed in the structure, the placement space can be reduced. Accordingly, a light source for lighting or lighting apparatus using light-emitting device 1 can be downsized, which is described later.

Figure 14:
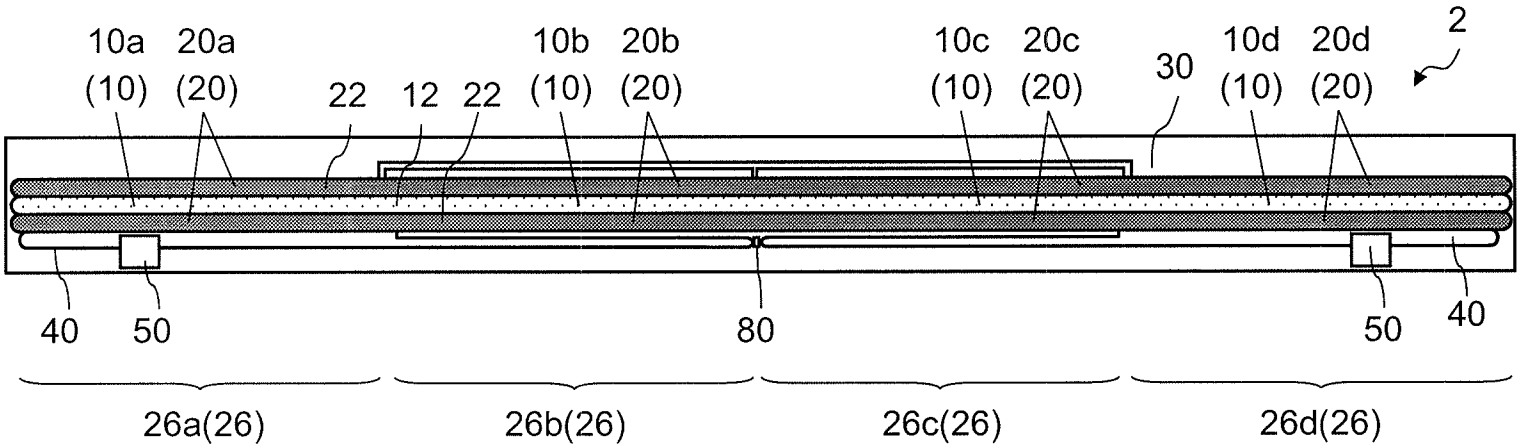
FIG. 14 is a plan view of another light-emitting device in accordance with the exemplary embodiment.
Figure 15:
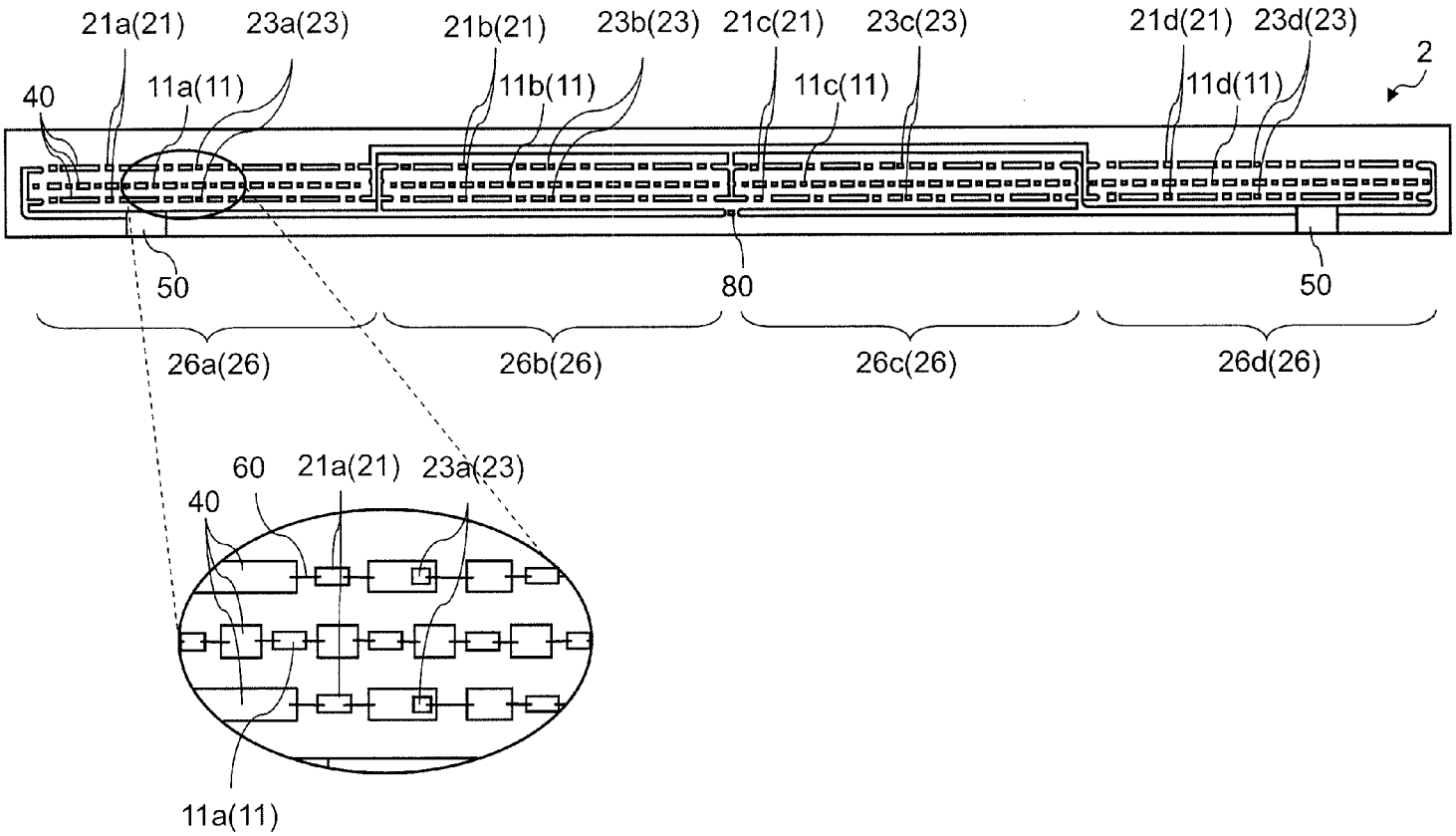
FIG. 15 is a plan view of the light-emitting device (before forming a sealing member and before installing an electrode terminal) in FIG. 14.
Figure 16:
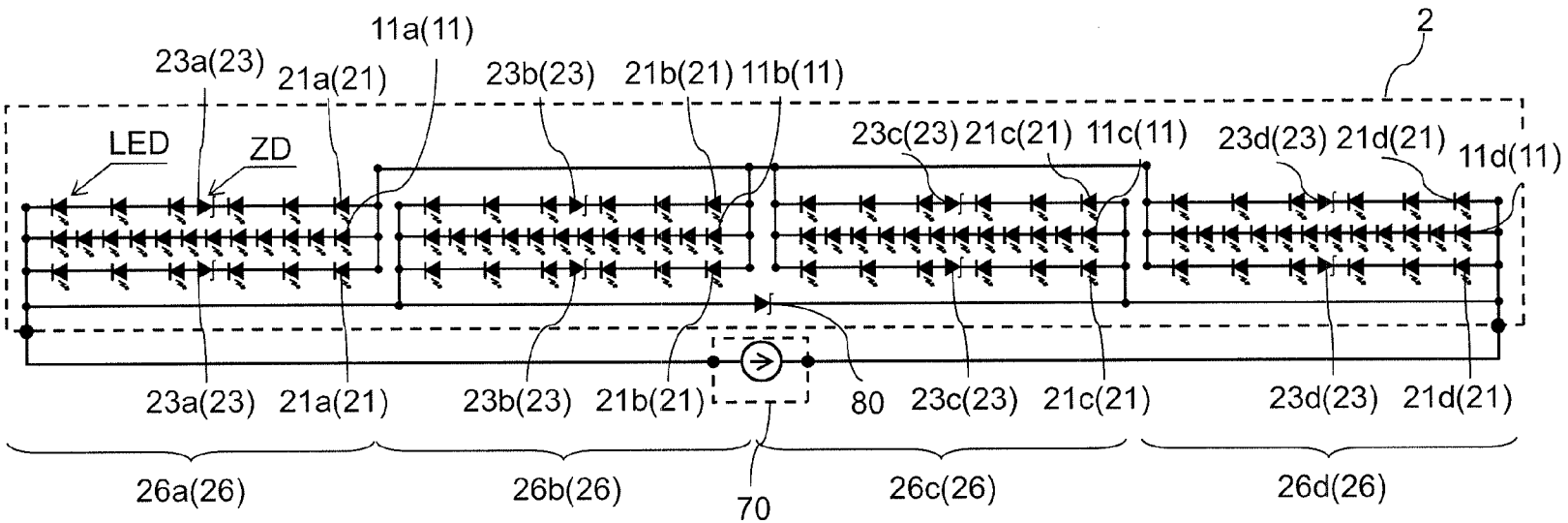
FIG. 16 is a circuit diagram of the light-emitting device in FIG. 14.

Next, the structure of another light-emitting device in the exemplary embodiment is described with reference to FIGS. 14, 15, and 16. FIGS. 14 and 15 are plan views of light-emitting device 2 in the exemplary embodiment. FIG. 14 illustrates the state after forming a sealing member and providing an electrode terminal. FIG. 15 illustrates the state before forming the sealing member and before providing the electrode terminal. FIG. 16 is a circuit diagram of light-emitting device 2.

A point that light-emitting device 2 differs from light-emitting device 1 is four pairs of parallel connectors when one row (one line) of the first light-emitting elements and two rows (two lines) of the second light-emitting elements are counted as one pair. More specifically, light-emitting device 1 has one row (one line) of each of first light-emitting element 10 and second light-emitting element 20, i.e., two rows (two lines) of light-emitting elements in total. On the other hand, in light-emitting device 2, one row (one line) of first light-emitting element 10 and two rows (two lines) of second light-emitting elements 20, in total three rows (three lines) of light-emitting elements are included in each of parallel connectors 26*a*, 26*b*, 26*c*, and 26*d*, which configures the basic structure. In other words, parallel connector 26*a* (26*b*, 26*c*, 26*d*) is configured with one row (one line) of first light-emitting element 10*a* (10*b*, 10*c*, 10*d*) and two rows (two lines) of second light-emitting element 20*a* (20*b*, 20*c*, 20*d*). Parallel connector 26 is equivalent to the light-emitting device including first light-emitting element 10 and second light-emitting element 20. In the following description, parallel connectors 26*a*, 26*b*, 26*c*, and 26*d* are indicated as parallel connector 26 when they need not to be distinguished. Still more, first light-emitting elements 10*a*, 10*b*, 10*c*, and 10*d* are indicated as first light-emitting element 10 when they need not to be distinguished. Second light-emitting elements

20*a*, 20*b*, 20*c*, and 20*d* are indicated as second light-emitting element 20 when they need not to be distinguished.

First light-emitting element 10 includes multiple first LEDs 11, and emits the first light-emitting spectrum. Second light-emitting element 20 includes multiple second LEDs 21 and constant voltage element 23 connected to second LEDs 21 in series, and emits the second spectrum different from the first light-emitting spectrum. In addition, two second light-emitting elements 20 are disposed sandwiching first light-emitting element 10.

Light-emitting device 2 further includes protection element 80, and same as light-emitting device 1, board 30, wiring 40 formed on board 30, electrode terminal 50 electrically connected to wiring 40, and wire 60. Light-emitting device 2 is an LED module with the COB structure in which LED chips are directly mounted on board 30.

The IF-VF characteristics of two second light-emitting elements 20 are the same. Lines indicating the IF-VF characteristics of one first light-emitting element 10 and two second light-emitting elements 20 are set to cross each other.

In light-emitting device 2, first light-emitting element 10, second light-emitting element 20, board 30, wiring 40, electrode terminal 50, and wire 60 have the same structures as those in light-emitting device 1. In other words, the IF-VF characteristic of each of first light-emitting element 10 and second light-emitting element 20 in light-emitting device 2 is same as the characteristic shown in FIG. 4.

Protection element 80 is a static protection element for protecting first LEDs 11 and second LEDs 21 from static electricity, and one or multiple pieces are mounted on board 30. In general, LEDs have low reverse withstand voltage, and thus LEDs may be destroyed by static electricity with reverse polarity generated on board 30. To prevent this from happening, protection element 80 is connected in parallel to first LEDs 11 and second LEDs 21 in a direction of reverse polarity relative to polarities of these LEDs. As protection element 80, for example, a zener diode is used. In light-emitting device 2, one zener diode is provided on board 30.

As shown in FIG. 16, in each of parallel connectors 26 of light-emitting device 2, one first light-emitting element and two second light-emitting elements are connected in parallel. In each first light-emitting element 10, twelve first LEDs 11 (VF=about 3V) are connected in series. In each second light-emitting element 20, six second LEDs 21 (VF=about 3V) and one constant voltage element 23 (zener diode with breakdown voltage Vz of 18.5 V) are connected in series.

Parallel connectors 26 are also connected two in parallel and two in series. More specifically, parallel connectors 26*a* and parallel connector 26*b* connected in parallel and parallel connector 26*c* and parallel connector 26*d* connected in parallel are connected in series. However, all parallel connectors 26 can be connected in series or all parallel connectors may be connected in parallel. In other words, parallel connectors 26 in which first light-emitting element 10 and second light-emitting element 20 are connected in parallel may be further connected in series or parallel. This enables to match the driving voltage and driving current of light-emitting device 2 to specifications of power circuit 70.

Still more, first light-emitting elements 10*a*, 10*b*, 10*c*, and 10*d* are integrally and linearly sealed, as shown in FIG. 14, using first sealing member 12 in light-emitting device 2. Second sealing member 22 integrally and linearly seals two sets of second light-elements 20*a*, 20*b*, 20*c*, and 20*d*, respectively. In other words, second sealing member 22 can integrally and linearly seal the second light-emitting element of one parallel connector and the second light-emitting element of another parallel connector. This achieves a linear light source in which multiple parallel connectors are aligned.

Still more, the zener diode, which is protection element 80, is connected in parallel to parallel connectors 26 connected two in parallel and two in series.

Light-emitting device 2 is connected, for example, to power circuit 70 having constant current source, same as light-emitting device 1. This enables to supply predetermined DC current (constant current) to light-emitting device 2.

As described above, light-emitting device 2 obtains the effect same as light-emitting device 1.

More specifically, a proportion of current running to one first light-emitting element 10 and two second light-emitting elements 20 can be changed by changing the amount of current input to light-emitting device 2. Accordingly, spectral distribution of light-emitting device 2 changes when current supplied from power circuit 70 is changed just by connecting single power circuit 70 to light-emitting device 2. Therefore, required tuning is feasible by single power source. However, since light-emitting device 2 has one first light-emitting element 10 and two second light-emitting elements 20, a proportion of current running to one first light-emitting element 10 and two second light-emitting elements 20 differs from that in light-emitting device 1.

Still more, light-emitting device 2 can also gain effects same as that of light-emitting device 1, including prevention of color variations, suppression of enlargement of device, suppression of color separation, and no need of a broad placement space.

In particular, if the light-emitting device is a linear light source, color separation may occur at tuning. However, color separation at tuning can be effectively suppressed by sandwiching one row of first light-emitting element 10 having the first color temperature between two rows of second light-emitting element 20 having the second color temperature, which is the structure of light-emitting device 2.

Light-emitting device 2 includes one row of first light-emitting element 10 and two rows of second light-emitting elements 20. However, light-emitting device 2 is not limited to this structure.

More specifically, in parallel connectors 26 configured by connecting first light-emitting element 10 and second light-emitting element 20 in parallel, it is only necessary to provide at least multiple first light-emitting elements 10 or multiple second light-emitting elements 20. In other words, at least the next structure is achieved: first light-emitting element 10 is one of multiple first light-emitting elements, or second light-emitting element is one of multiple second light-emitting elements. For example, there may be two rows of first light-emitting element 10 and one row of second light-emitting element 20. The total number of rows of first light-emitting element 10 and second light-emitting element 20 is not limited to three rows. There may be four or more rows. In this case, the number of rows of first light-emitting element 10 and second light-emitting element 20 can be set as appropriate. With respect to influence of the first spectrum and the second spectrum on mixed color, the proportion of the spectrum (color temperature) emitted from more rows of light-emitting elements can be increased by setting a different number of rows for first light-emitting element 10 and second light-emitting element 20.

Figure 17:
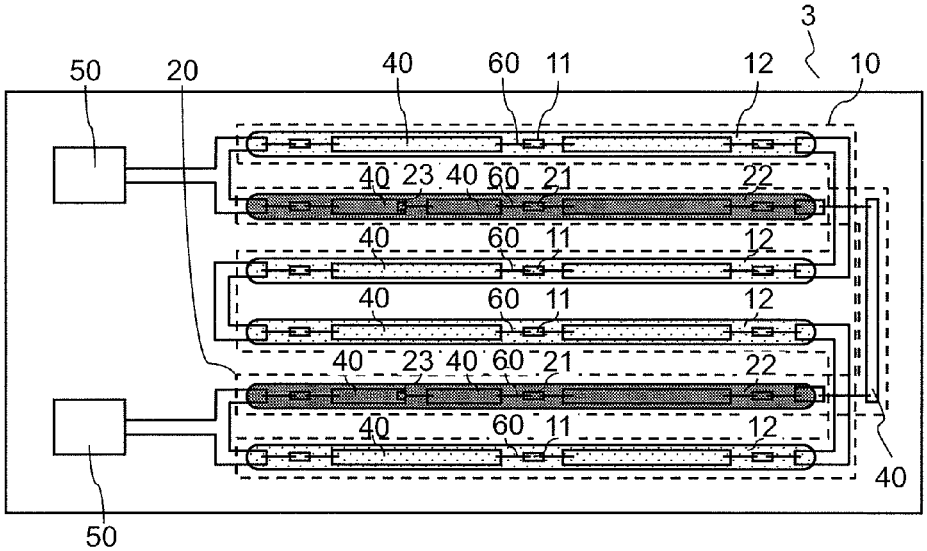
FIG. 17 is a plan view of still another light-emitting device in accordance with the exemplary embodiment.

Still more, at least first light-emitting element 10 or second light-emitting element 20 may be disposed over multiple rows. For example, still another light-emitting device 3 shown in FIG. 17 may be configured. Also in light-emitting device 3 shown in FIG. 17, first light-emitting element (twelve series connections/without ZD) 10 and second light-emitting element (six series connections/with ZD) 20 are connected in parallel. In first light-emitting element 10, twelve first LEDs 11 are connected in series. In second light-emitting element 20, six second LEDs 21 and constant voltage element 23 are connected in series.

Still more, in first light-emitting element 10, twelve first LEDs 11 are linearly disposed in four rows. In second light-emitting element 20, six second LEDs 21 and constant voltage element 23 are linearly disposed in two rows.

In other words, light-emitting device 3 at least has the next structure: multiple first light-emitting LEDs 11 are linearly disposed in multiple rows in first light-emitting element 10, or multiple second light-emitting LEDs 21 and constant voltage element 23 are linearly disposed in multiple rows in the second light-emitting element.

Figure 18:
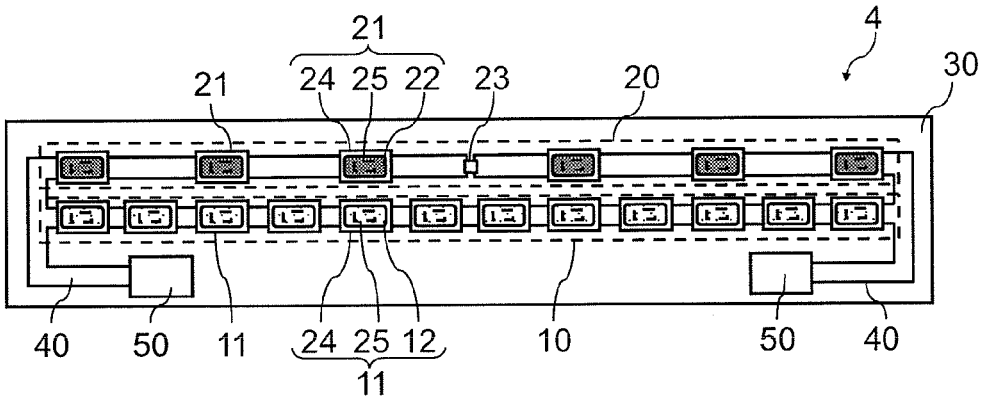
FIG. 18 is a plan view of still another light-emitting device in accordance with the exemplary embodiment.

The above description refers to a light-emitting device with COB structure in light-emitting device 1 to light-emitting device 3. As still another light-emitting device, as shown in FIG. 18, light-emitting device 4 with SMD structure may be used. Light-emitting device 4 includes board 30, first light-emitting element 10 and second light-emitting element 20 provided on board 30, wiring 40 formed on board 30, and electrode terminal 50 electrically connected to wiring 40.

First light-emitting element 10 includes multiple first LEDs 11 connected in series, and emits light in the first spectrum. Second light-emitting element 20 includes second LED 21 and constant voltage element 23 connected in series, and emits light in the second spectrum different from the first spectrum.

Spectrums of first light-emitting element 10 and second light-emitting element 20 have different color temperatures (emitted light colors). For example, the color temperature in second light-emitting element 20 is set to be higher than the color temperature in first light-emitting element 10.

In light-emitting device 4, first LED 11 and second LED 21 are SMD LED elements, and includes package (cavity) 24 that is a container molded using non-translucent resin (white resin, etc.), and LED chip 25 mounted on the bottom of the cavity of package 24. In first LED 11, first sealing member 12 is filled in the cavity of package 24 so as to seal LED chip 25. In second LED 21, second sealing member 22 is filled in the cavity of package 24 so as to seal LED chip 25. For LED chip 25, a blue LED chip may be used same as light-emitting device 1.

Also in light-emitting device 4, first light-emitting element 10 and second light-emitting element 20 are connected in parallel. In addition, lines indicating IF-VF characteristics are set to intersect. A single power circuit is connected to light-emitting device 4, and spectral distribution of light-emitting device 4 can be changed just by changing the forward current supplied from the power circuit. In other words, required tuning becomes feasible just by a single power source.

(Light Source for Lighting)

Next is described a light source for lighting in the exemplary embodiment.

Figure 19:
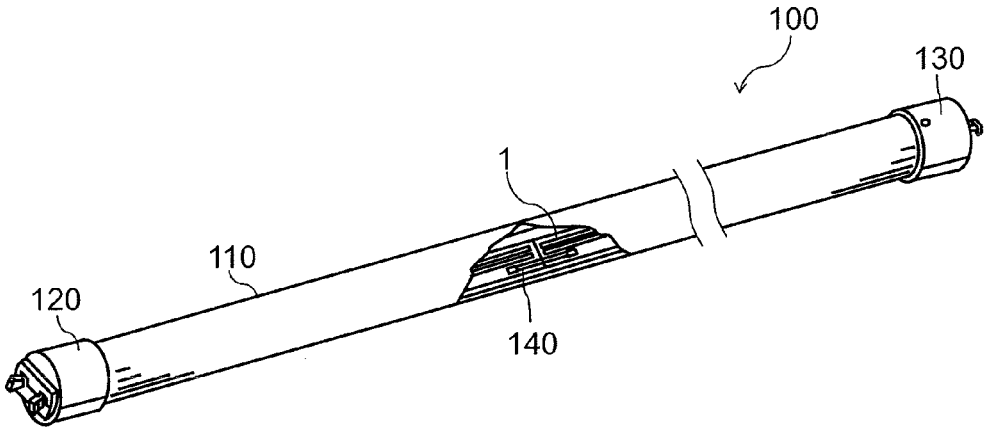
FIG. 19 is a perspective view of an appearance of a straight-tube LED lamp in accordance with the exemplary embodiment.

First, straight-tube LED lamp 100, which is an example of the light source for lighting, is described with reference to FIG. 19. FIG. 19 is a perspective view of an appearance of straight-tube LED lamp 100. Straight-tube LED lamp 100 is an example of applying light-emitting device 1 to a straight-tube LED lamp.

Straight-tube LED lamp 100 can be replaced with a conventional straight-tube fluorescent lamp. Straight-tube LED lamp 100 includes long tubular housing 100 made of glass or resin, multiple light-emitting devices 1 disposed in housing 110, and a pair of bases 120 and 130.

Multiple light-emitting devices 1 are, for example, electrically connected by connector line 140. A predetermined base whose power supply method is specified by the Japanese Industrial Standard can be used for bases 120 and 130. For example, GX16t-5 or G13 base can be used.

Although not illustrated, housing 110 may have a lighting circuit for lighting light-emitting device 1 or a heat sink (metal base) for placing light-emitting device 1.

As described above, light-emitting device 1 can be used as a light source of the straight-tube LED lamp. This enables to achieve a tunable straight-tube LED lamp. Straight-tube LED lamp 100 employs light-emitting device 1, but light-emitting device 2 to light-emitting device 4 may also be used.

Straight-tube LED lamp 100 can also be used as a night light when input current is reduced by setting required chromaticity to two light colors of first light-emitting element 10 and second light-emitting element 20.

Figure 20:
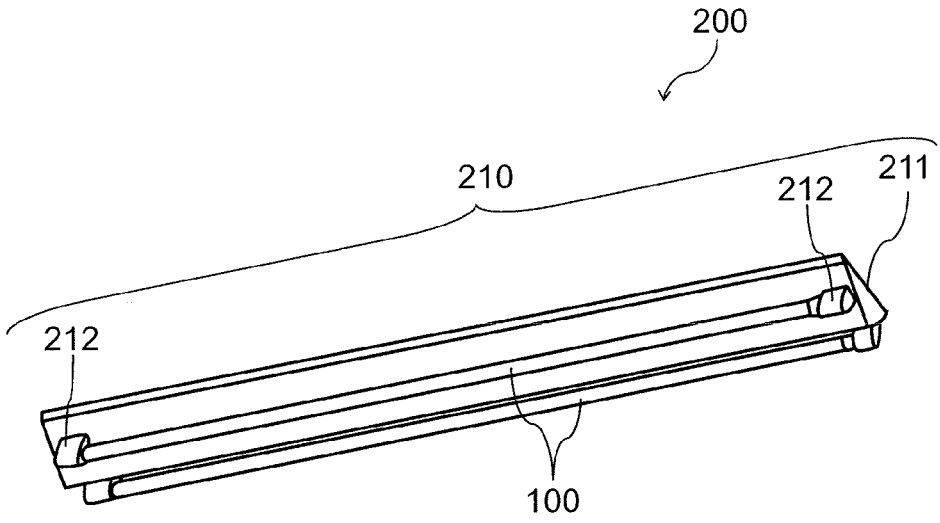
FIG. 20 is a perspective view of a lighting apparatus in accordance with the exemplary embodiment, using the straight-tube LED lamp in FIG. 19.

Still more, as shown in FIG. 20, straight-tube LED lamp 100 can be used in lighting apparatus 200. FIG. 20 is a perspective view of lighting apparatus 200 using straight-tube LED lamp 100 in the exemplary embodiment.

Lighting apparatus 200 is a lighting apparatus having straight-tube LED lamp 100. For example, lighting apparatus 200 includes straight-tube LED lamp 100 shown in FIG. 19 and lighting fixture 210.

Lighting fixture 210 includes fixture body 211 and a pair of sockets 212 attached to fixture body 211. This pair of sockets 212 is electrically connected to straight-tube LED lamp 100, and also holds straight-tube LED lamp 100. For example, fixture body 211 can be formed by pressing an aluminized sheet. An inner side of fixture body 211 is a reflective face that reflects the light emitted from straight-tube LED lamp 100 in a predetermined direction (e.g., downward).

Lighting fixture 210 is attached, for example, to a ceiling via a fitting. Lighting fixture 210 typically has a built-in power circuit for controlling lighting of straight-tube LED lamp 100. A translucent cover may be provided to cover straight-tube LED lamp 100.

Figure 21:
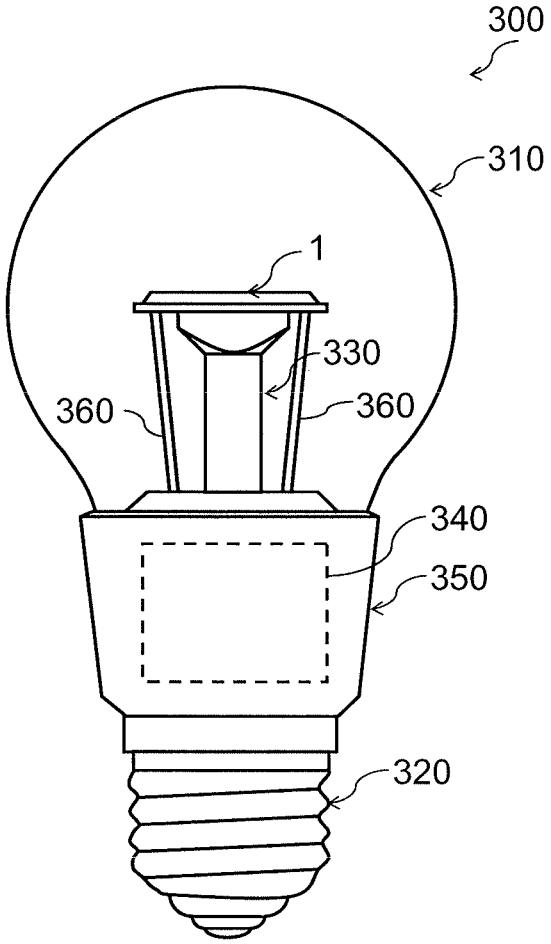
FIG. 21 is a perspective view of an appearance of a LED bulb lamp in accordance with the exemplary embodiment.

Next is described LED bulb lamp 300 as another example of a light source for lighting with reference to FIG. 21. FIG. 21 is a perspective view of an appearance of LED bulb lamp 300 in the exemplary embodiment. LED bulb lamp 300 is an example of applying light-emitting device 1 to a LED bulb lamp.

LED bulb lamp 300 can be replaced with conventional fluorescent bulb lamp or incandescent bulb. LED bulb lamp 300 includes light-emitting device 1, translucent globe 310 for covering light-emitting device 1, base 320 for receiving power, metal support 330 for supporting light-emitting device 1, power circuit 340 for supplying DC power to light-emitting device 1, resin case 350 that is a casing member for covering power circuit 340, and a pair of lead wires 360 for electrically connecting power circuit 340 and light-emitting device 1. Globe 310 and case 350 are so-called housing. Base 320 is attached to case 350, which is the housing.

In this way, light-emitting device 1 can be used as a light source of LED bulb lamp (LED bulb). This enables to achieve a tunable LED bulb lamp. LED bulb lamp 300 employs light-emitting device 1, but light-emitting device 2 to light-emitting device 4 may also be used.

In LED bulb lamp 300, a luminous flux difference due to light color difference can be suppressed by setting required chromaticity to two light colors in first light-emitting element 10 and second light-emitting element 20.

Figure 22:
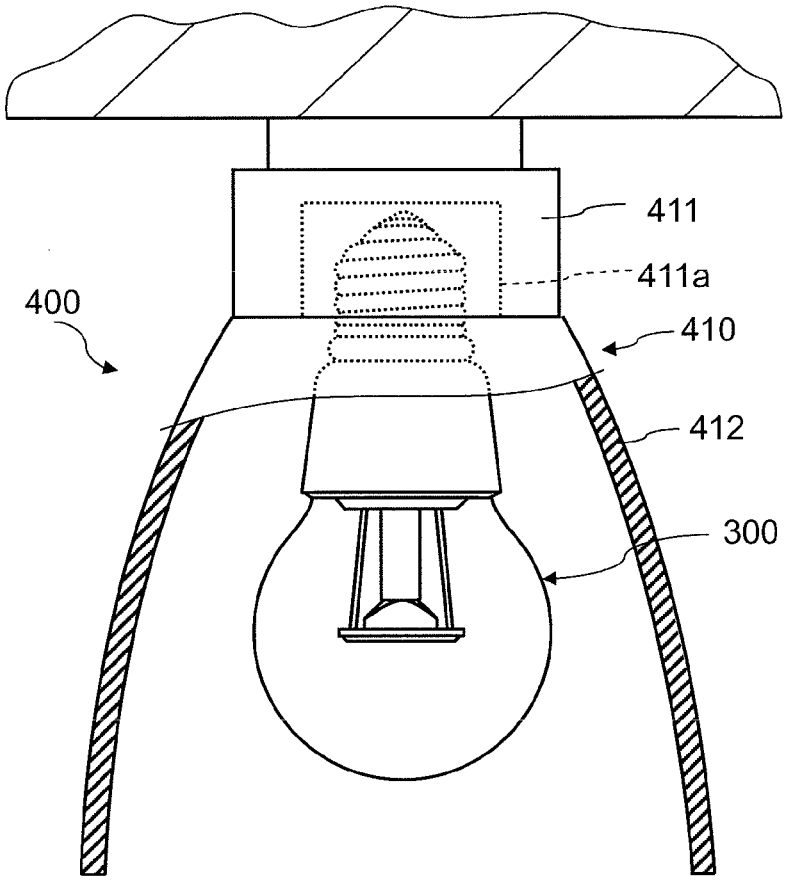
FIG. 22 is a perspective view of a lighting apparatus in the exemplary embodiment, using the LED bulb lamp in FIG. 21.

Still more, LED bulb lamp 300 can be used in lighting apparatus 400, as shown in FIG. 22. FIG. 22 is a perspective view of lighting apparatus 400 employing LED bulb lamp in the exemplary embodiment.

Lighting apparatus 400 includes LED bulb lamp 300 and lighting fixture 410 attached to LED bulb lamp 300. In this case, lighting fixture (lighting tool) 410 includes, for example, fixture body 411 to be attached to a ceiling and lamp cover 412 for covering LED bulb lamp 300.

Fixture body 411 includes socket 411*a* for supplying power to LED bulb lamp 300. Base 320 of LED bulb lamp 300 is attached to socket 411*a*. A translucent plate may be provided on an opening of lamp cover 412.

Next is described another lighting apparatus in the exemplary embodiment.

Figure 23:
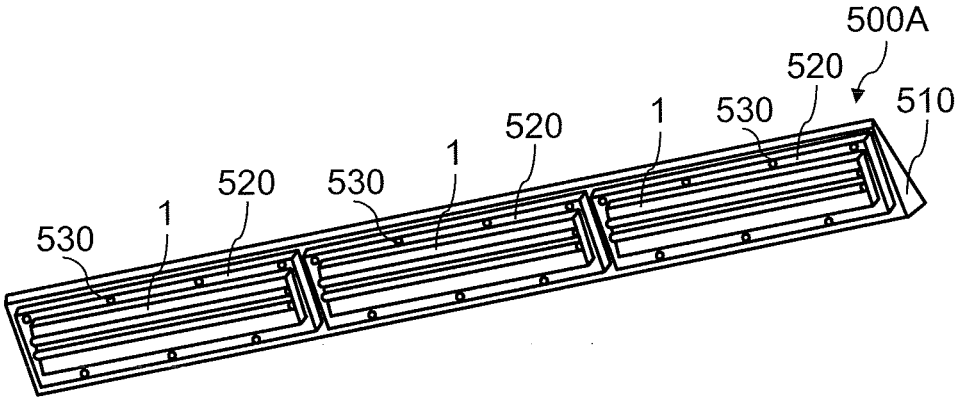
FIG. 23 is Example 1 of another lighting apparatus in accordance with the exemplary embodiment.
Figure 24:
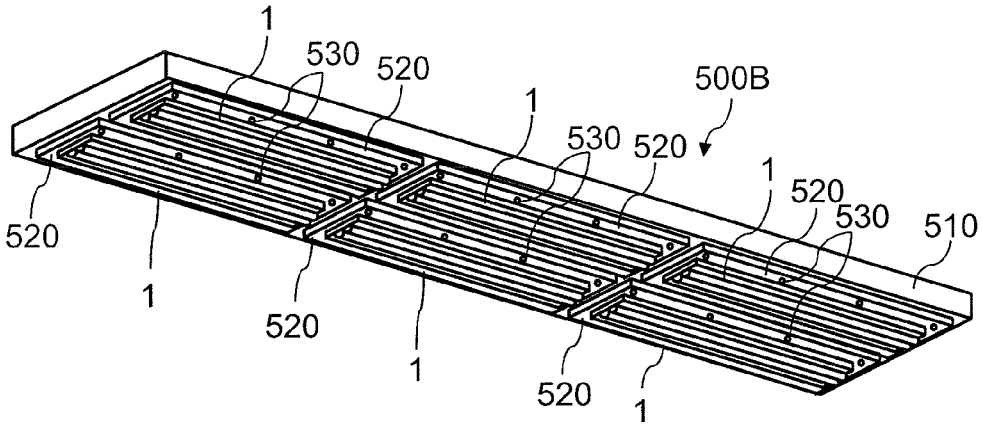
FIG. 24 is Example 2 of still another lighting apparatus in accordance with the exemplary embodiment.
Figure 25:
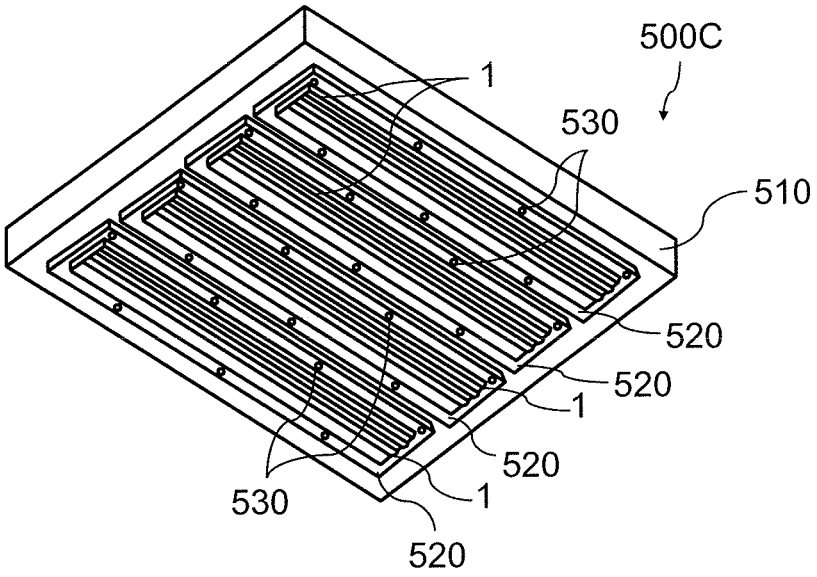
FIG. 25 is Example 3 of still another lighting apparatus in accordance with the exemplary embodiment.

First to third examples of another lighting apparatus in the exemplary embodiment are described with reference to FIGS. 23 to 25. FIGS. 23 to 25 show another lighting apparatuses 500A to 500C in the exemplary embodiment.

Lighting apparatuses 500A to 500C are all baselight lighting apparatuses. They include light-emitting device 1, lighting fixture 510, and attachment member 520 for attaching light-emitting device 1 to lighting fixture 510. Light-emitting device 1 is attached to lighting apparatus 510 via attachment member 520. Light-emitting device 1 is attached to attachment member 520 using a fixing means such as screw and adhesive.

Lighting fixture 510 has a built-in power circuit for controlling lighting of light-emitting device 1. Lighting fixture 510 also has a screw hole that matches a through hole in attachment member 520. In other words, a position of the through hole of attachment member 520 and a position of a screw hole of lighting fixture 510 match. Lighting fixture 510 may be typically formed by pressing an aluminized sheet, and is directly attached typically to a ceiling.

Attachment member 520 is a long board, and a metal sheet configured with a long aluminum sheet may be used. Attachment member 520 has multiple through holes. To fix attachment member 520 and lighting fixture 510, the through hole of attachment member 520 and the screw hole of lighting fixture 510 are matched, and screw 530 is passed through the through hole to screw the through hole and screw hole together.

Lighting apparatus 500A shown in FIG. 23 includes convex lighting fixture 510 and three light-emitting devices 1 attached to each of two slopes.

Lighting apparatus 500B shown in FIG. 24 includes rectangular lighting fixture 510 in a plan view, and six light-emitting devices 1 attached to its surface.

Lighting apparatus 500C shown in FIG. 25 includes square lighting fixture 510 in a plan view, and four light-emitting devices 1 attached to it.

The number of light-emitting devices 1 attached to the lighting fixture in lighting apparatuses 500A to 500C is not particularly limited. In addition, although not illustrated, a transparent cover for covering light-emitting device 1 may be provided in lighting apparatuses 500A to 500C. Still more, one attachment member 520 is used for one light-emitting device 1. However, the structure is not limited. Still more, lighting apparatuses 500A to 500C employ light-emitting device 1, but light-emitting device 2 to light-emitting device 4 may also be used.

The light-emitting device, light source for lighting, and lighting apparatus in the exemplary embodiment are described above with reference to the exemplary embodiment. However, it is apparent that the disclosure is not limited to these embodiments.

The above embodiments refer to examples of using light-emitting devices 1 to 4 in the light source for lighting and lighting apparatus. However, their application is not limited. For example, other than these examples, each of light-emitting devices 1 to 4 may be used as a light source for guide lights or signboard devices.

Still more, straight-tube LED lamp 100 and LED bulb lamp 300 are given as examples of applying the light-emitting device to the light source for lighting in the above exemplary embodiment. However, the light-emitting device is also applicable to round-tube lamps.

Still more, light-emitting device 1 (LED module) refers to a combination of a blue LED chip and yellow phosphor. However, the combination is not limited. For example, resin containing red phosphor and green phosphor may be used and this may be combined with a blue LED. Alternatively, an ultraviolet LED chip that emits ultraviolet ray with a wavelength shorter than that of the blue LED chip and blue phosphor particles, green phosphor particles, and red phosphor particles that discharge blue light, red light, and green light when excited mainly by ultraviolet light may be combined.

Still more, first sealing member 12 and second sealing member 22 contain phosphor as a wavelength conversion material in light-emitting devices 1 to 4. However, they may not contain phosphor. In this case, the color temperature of first LED 11 and the color temperature of second LED 21 may be set different.

Still more, light-emitting devices 1 to 4 refer to two light-emitting elements of first light-emitting element 10 and second light-emitting element 20. However, a third light-emitting element that has the color temperature different from that of spectrums emitted from first light-emitting element 10 and second light-emitting element 20 may be provided.

Still more, multiple first LEDs 11 and multiple second LEDs 21 are connected in series, respectively, in light-emitting devices 1 to 4. However, a part of first LEDs 11 or second LEDs 21 may be connected in parallel. The shape of line indicating each of the IF-TV characteristic can be changed.

Still more, blue LEDs are used for multiple first LEDs 11 and multiple second LEDs 21. However, other colors, such as green and red LEDs may be used. Furthermore, LEDs with different light colors may exist in each of first light-emitting element 10 and second light-emitting element 20.

Still more, multiple first LEDs 11 and multiple second LEDs 21 are aligned in a straight line, respectively. However, they may be disposed in a curved line. For example, they may be disposed in a concentric fashion. This achieves a round luminous region.

Still more, light-emitting devices 1 to 4 refer to LED as a semiconductor light-emitting element. However, other semiconductor light-emitting elements such as semiconductor laser, EL elements such as organic EL (Electro Luminescence) and inorganic EL, and other solid light-emitting elements may be used.

Embodiments achieved by a range of modifications that may come up to each exemplary embodiment and embodiments achieved by arbitrary combining components and functions of each exemplary embodiment without departing from the spirit of the disclosure are intended to be embraced therein.

The disclosure refers to the first light-emitting element and the second light-emitting element connected in parallel. The first light-emitting element includes the first LED and emits the first spectrum, and the second light-emitting element includes the second LED and constant voltage element connected in series and emits the second spectrum. This structure enables to change the spectral distribution emitted from the light-emitting device just by changing power supplied from a single power circuit.

What is claimed is:

1. A light-emitting device, comprising:

a first light-emitting element including a first light-emitting diode, and configured to emit a first spectrum; and a second light-emitting element including a second light-emitting diode and a constant voltage element connected in series to the second light-emitting diode, the second light-emitting element configured to emit a second spectrum different from the first spectrum and connected in parallel to the first light-emitting element, wherein a line indicating a relation between a forward-current and a forward-voltage of the first light-emitting element crosses with a line indicating a relation between a forward-current and a forward-voltage of the second light-emitting element.

2. The light-emitting device of claim 1, wherein a color temperature of the first spectrum is different from a color temperature of the second spectrum.

3. The light-emitting device of claim 2, wherein the color temperature of the second spectrum is higher than the color temperature of the first spectrum.

4. The light-emitting device of claim 3, wherein the color temperature of the first spectrum is not less than 2000 K and not greater than 3000 K, and the color temperature of the second spectrum is not less than 5500 K and not greater than 14000 K.

5. The light-emitting device of claim 2, wherein a color temperature of a light emitted from the first light-emitting diode is different from a color temperature of a light emitted from the second light-emitting diode.

6. The light-emitting device of claim 1, wherein the constant voltage element is a zener diode.

7. The light-emitting device of claim 6, wherein a ratio of a breakdown voltage of the zener diode to a forward voltage at a point where the line indicating the relation between the forward-current and the forward-voltage of the first light-emitting element crosses with the line indicating the relation between the forward-current and the forward-voltage of the second light-emitting element is not less than 34% and not greater than 51%.

8. The light-emitting device of claim 1, wherein at least one of:

the first light-emitting element is one of a plurality of first light-emitting elements, and the second light-emitting element is one of a plurality of second light-emitting elements.

9. The light-emitting device of claim 1, wherein the first light-emitting diode and the second light-emitting diode are each one of a plurality of first light-emitting diodes and a plurality of second light-emitting diodes, respectively, and the first light-emitting element includes the plurality of first light-emitting diodes, and the second light-emitting element includes the plurality of second light-emitting diodes.

10. The light-emitting device of claim 9, wherein the plurality of first light-emitting diodes is connected in series, and the plurality of second light-emitting diodes and the constant voltage element are connected in series.

11. The light-emitting device of claim 9, wherein the plurality of first light-emitting diodes is linearly aligned, and the plurality of second light-emitting diodes and the constant voltage element are linearly aligned.

12. The light-emitting device of claim 11, wherein the plurality of first light-emitting diodes and the plurality of second light-emitting diodes are each a plurality of bare chips, and each row of the plurality of first light-emitting diodes and the plurality of second light-emitting diodes is integrally sealed using a sealing member containing a wavelength conversion material.

13. The light-emitting device of claim 12, wherein the sealing member is linearly disposed.

14. The light-emitting device of claim 9 is at least one of:

the plurality of first light-emitting diodes is linearly aligned in a plurality of rows in the first light-emitting element, and the plurality of second light-emitting diodes and the constant voltage element are linearly aligned in a plurality of rows in the second light-emitting element.

15. A light source for lighting, comprising:

a housing;

the light-emitting device of claim 1 housed in the housing; and a base attached to the housing.

16. A lighting apparatus, comprising:

the light-emitting device of claim 1;

a lighting fixture; and an attachment member for attaching the light-emitting device to the lighting fixture.

* * * * *